US007233747B2

(12) United States Patent
Tomitaka

(10) Patent No.: US 7,233,747 B2
(45) Date of Patent: Jun. 19, 2007

(54) IMAGE FORMING APPARATUS MOUNTED WITH REPLACEABLE UNIT, IMAGE FORMING SYSTEM, AND METHOD OF CONTROLLING IMAGE FORMING APPARATUS

(75) Inventor: Kenichirou Tomitaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 165 days.

(21) Appl. No.: 11/084,811

(22) Filed: Mar. 21, 2005

(65) Prior Publication Data

US 2005/0254841 A1 Nov. 17, 2005

(30) Foreign Application Priority Data

May 17, 2004 (JP) ..... P.2004-146149

(51) Int. Cl.
*G03G 15/00* (2006.01)

(52) U.S. Cl. ..... 399/12; 399/82; 399/111

(58) Field of Classification Search ..... 399/12, 399/111, 81, 82, 24, 27, 8, 9; 347/19, 49, 347/86

See application file for complete search history.

(56) References Cited

U.S. PATENT DOCUMENTS 6,658,219 B1 * 12/2003 Ito et al. ..... 399/27
7,050,726 B2 * 5/2006 Adkins et al. ..... 399/12
2002/0131784 A1 * 9/2002 Takemoto ..... 399/12
2005/0078969 A1 * 4/2005 Kikuchi ..... 399/12
2005/0163514 A1 * 7/2005 Hwang ..... 399/8
2005/0244169 A1 * 11/2005 Ono ..... 399/12
2005/0244170 A1 * 11/2005 Ono et al. ..... 399/12
2005/0254839 A1 * 11/2005 Nagamine et al. ..... 399/12

FOREIGN PATENT DOCUMENTS

JP A 6-149051 5/1994
JP B2 2602341 1/1997
JP A 10-133528 5/1998
JP A 2001-100598 4/2001
JP B2 3476704 9/2003

* cited by examiner

*Primary Examiner*—Sophia S. Chen
(74) *Attorney, Agent, or Firm*—Oliff & Berridge, PLC

(57) ABSTRACT

An image forming apparatus sets operation modes different from an operation mode corresponding to a genuine article when the replaceable unit of the non-article article is mounted thereto, such that a user can select an operation mode via a UI device. And then, the image forming apparatus stores history information regarding an operation mode selected by the selection of the user, attribute information of a mounted replaceable unit (for example, a determination result of determining whether or not the replaceable unit is the genuine article), and history information (the number of printing sheets, error codes, or the like) of a printing process which is made in the operation mode, to be associated with each other.

20 Claims, 25 Drawing Sheets

FIG. 14A

MOUNTING HISTORY (262)

| UNIT REPLACEMENT DATE AND TIME | ATTRIBUTE INFORMATION | | | CONSUMPTION |
|---|---|---|---|---|
| | MANUFACTURER'S SERIAL NUMBER | COUNTRY CODE | DISCRIMINATION RESULT | |
| 02/01/05 (11:15) C TONER MOUNTING | 0123456 | JP | GENUINE ARTICLE | 32432 |
| 02/01/07 (17:00) Y TONER MOUNTING | 0223456 | JP | GENUINE ARTICLE | 10223 |
| 02/02/02 (09:00) Y TONER REMOVAL | 0223456 | JP | GENUINE ARTICLE | 42005 |
| 02/02/02 (09:15) Y TONER MOUNTING | 0223456 | JP | NON-GENUINE ARTICLE | 42005 |
| ⋮ | ⋮ | ⋮ | ⋮ | ⋮ |

| | |
|---|---|
| 02/02/02 (12:30) | CONSUMPTION 120 |
| ⋮ | ⋮ |

FIG. 14B

OPERATION MODE HISTORY (270)

| OPERATION MODE SWITCHING DATE AND TIME | APPLIED OPERATION MODE | DETAILED INFORMATION OF OPERATION MODE |
|---|---|---|
| 02/01/05 | DEFAULT MODE S | NULL |
| 02/03/11 | MODE A | CORRECTION PARAMETER A001<br>CORRECTION PARAMETER B012 |
| ⋮ | ⋮ | ⋮ |

FIG. 14C

PRINTING HISTORY (272)

| PRINTINIG DATE AND TIME | ERROR CODE | THE NUMBER OF PRINTING SHEETS |
|---|---|---|
| 02/01/05 (12:30)<br>JOB 0123 | NONE | 15 |
| 02/01/05 (12:45)<br>JOB 0124 | 16-38 | 45 |
| ⋮ | ⋮ | ⋮ |

FIG. 24

299

| Replacement Unit Name | Operation Mode Name After Switching | The Number of Printing Sheets When Switching | Switching Date and Time |
|---|---|---|---|
| Toner (C) | Mode A | 1248 Sheets | 04/03/17 |
| Toner (M) | Mode B | 1250 Sheets | 04/03/17 |
| Toner (Y) | Mode A | 1257 Sheets | 04/03/17 |
| Toner (K) | Mode C | 1519 Sheets | 04/03/22 |
| ⋮ | ⋮ | ⋮ | ⋮ |

IMAGE FORMING APPARATUS MOUNTED WITH REPLACEABLE UNIT, IMAGE FORMING SYSTEM, AND METHOD OF CONTROLLING IMAGE FORMING APPARATUS

BACKGROUND OF THE INVENTION

1. Field of the Invention

The present invention relates to an image forming apparatus mounted with replaceable units, an image forming system, and a method of controlling the image forming apparatus, and more specifically, to an image forming apparatus in which the replaceable units are replaceably mounted in an image forming apparatus main body.

2. Background Art

An image forming apparatus which allows a user to easily replace a unit including consumables and the like is known.

Meanwhile, if a replaceable unit replaced by a user is not a genuine article for an image forming apparatus, there are problems in that the performance of the image forming apparatus cannot be sufficiently exhibited, like deterioration of the image quality, the operation of the apparatus cannot be guaranteed, or the apparatus can get out of order. This is because the image forming apparatus controls processes for forming an image in consideration of characteristics of a toner, characteristics of an image carrier, an electrification voltage, cleaning characteristics, fixing characteristics and the like.

Therefore, in order to maintain the image quality of an image forming apparatus, and to prevent occurrence of the above problems, JP-A-10-133528 discloses a method which comprises providing a genuine replaceable part with a data carrier for holding consumption data on consumables, and discriminating whether the genuine replaceable unit has been supplied with the consumables by comparing a consumption detected by a consumption detecting unit provided in an image forming apparatus main body with the consumption data held by the data carrier.

Further, JP-A-6-149051 discloses a method which comprises providing a toner cartridge with a storage unit for storing predetermined coded data, and inhibiting copying when the predetermined coded data stored in the storage unit has not yet been read from the copying machine main body side.

Further, JP-A-2001-100598 discloses a method which comprises performing warning display and printing inhibition when empty information to be written in a cartridge at the time of detection of run-out of a toner is read from a cartridge refilled with a toner.

Further, Japanese Patent No. 2602341 discloses a method which comprises making the count of the images formed and storing it in a memory of a cartridge, and, if a preset final count representing the number of images capable of being formed by a cartridge is equal to the count of images which are actually formed, disabling the cartridge from being used afterwards.

Moreover, Japanese Patent No. 3476704 discloses a method which comprises setting an image forming condition whose level is lowered than that of an appropriate image forming condition, thereby allowing a user to easily find the fact that a mounted toner refilling container is inappropriate, when it is determined that the toner refilling container is inappropriate through duplex communication between a communication unit of the toner refilling container side and a communication unit of an apparatus main body side, and a selective input unit selects the fact that the user continues to refill a toner while inappropriateness of the container is ignored.

SUMMARY OF THE INVENTION

An object of the present invention is to provide an image forming apparatus, an image forming system, and a method of controlling an image forming apparatus, which can use a replaceable unit other than a genuine article by a user's intention, even when the replaceable unit other than a genuine article is mounted. Another object of the present invention is to provide an image forming apparatus, an image forming system, and a method of controlling an image forming apparatus, which can manage replacement histories of a replaceable unit, switching histories of an operation mode, or the like.

According to a first aspect of the invention, there is provided an image forming apparatus including an image forming apparatus main body, at least one replaceable unit replaceably mounted to the image forming apparatus main body, an input unit for selecting any one of an operation mode corresponding to the replaceable unit which is a genuine article and operation modes different from the operation mode, a control unit for performing controls according to an operation mode selected by the input unit, and a storage unit for storing history information regarding the operation modes.

Preferably, the image forming apparatus further comprises a discriminating unit for discriminating whether or not the replaceable unit is the genuine article, in which the storage unit stores the history information regarding the operation modes in association with the discrimination results by the discriminating unit.

Preferably, the storage unit stores the history information regarding the operation modes on the assumption that an image formation process is performed according to the operation mode selected by the input unit.

Preferably, when an operation mode is switched by the control unit, the storage unit stores history information regarding the switching of the operation mode as the history information regarding the operation mode.

Preferably, the storage unit stores information regarding an image formation process performed for each operation mode in association with the history information regarding the switching of the operation mode.

Preferably, when an operation mode identical to the operation mode which is currently applied is selected by the input unit, the storage unit is prohibited from storing history information regarding the selected operation mode.

Preferably, the storage unit stores setting information, which defines an image formation process when being controlled according to other operation modes, in association with the history information regarding the operation mode.

According to a second aspect of the invention, there is provided an image forming apparatus including an image forming apparatus main body, at least one replaceable unit replaceably mounted to the image forming apparatus main body, a storage unit, provided in the replaceable unit, for storing attribute information of the replaceable unit, a discriminating unit for discriminating whether or not the replaceable unit is a genuine article, according to the attribute information read from the storage unit, and a storage unit for storing history information regarding a use of the replaceable unit, when it is determined by the discriminating unit that the mounted replaceable unit is a non-genuine article.

Preferably, the attribute information includes area information indicating an area in which the replaceable unit is to be used. Further, the discriminating unit compares previously stored area information to the area information read from the storage unit and discriminates whether or not the mounted replaceable unit is the genuine article. In addition, if the discriminating unit discriminates that the replaceable unit is the non-genuine article, the storage unit stores the area information of the mounted replaceable unit in association with the history information regarding the use of the replaceable unit.

Preferably, the storage unit stores the attribute information of the replaceable unit, which is sequentially replaced, in association with the history information.

Preferably, the attribute information includes unit identification information for identifying each replaceable unit. Further, the storage unit stores the unit identification information of the replaceable unit in association with the history information regarding the use of each replaceable unit.

Preferably, the storage unit stores the attribute information of the replaceable unit and the history information regarding the use of the replaceable unit only for the replaceable unit which is discriminated as the non-genuine by the discriminating unit.

Preferably, the image forming apparatus further comprises an abnormality detecting unit for detecting abnormality in an image formation process, in which the storage unit stores information regarding the abnormality detected by the abnormality detecting unit in association with the history information.

Preferably, the image forming apparatus further comprises an application quantity determining unit for determining whether or not an application quantity of each of other operation modes exceeds an established reference application quantity, based on the history information stored in the storage unit, and an output unit for outputting a purport that the application quantity of each of other operation modes exceeds a reference, when the application quantity determining unit determines that the application quantity exceeds the reference application quantity.

Preferably, the image forming apparatus further comprises a consumption determining unit for determining whether or not a consumption of each replaceable unit exceeds an established reference consumption, based on the history information stored in the storage unit, and an output unit for outputting a purport that the consumption of the replaceable unit exceeds a reference, when the consumption determining unit determines that the consumption exceeds the reference consumption for any one of the replaceable units.

According to a third aspect of the invention, there is provided an image forming system including an image forming apparatus, and a host apparatus connected to the image forming apparatus. Further, the image forming apparatus comprises an image forming apparatus main body, at least one replaceable unit replaceably mounted to the image forming apparatus main body, an input unit for selecting any one of an operation mode corresponding to the replaceable unit which is a genuine article and operation modes different from the operation mode, a control unit for performing controls according to an operation mode selected by the input unit, and a storage unit for storing history information regarding the operation modes. In addition, the host apparatus comprises a display unit for displaying the history information stored in the storage unit. Further, the host apparatus may store the history information stored in the storage unit to a record media. In other words, the host apparatus has a output unit for output the history information stored in the storage unit.

According to a fourth aspect of the invention, there is provided an image forming system including an image forming apparatus, and a host apparatus connected to the image forming apparatus. Further, the image forming apparatus comprises an image forming apparatus main body, at least one replaceable unit replaceably mounted to the image forming apparatus main body, an input unit for selecting any one of an operation mode corresponding to the replaceable unit which is a genuine article and operation modes different from the operation mode, a control unit for performing controls according to an operation mode selected by the input unit, a storage unit for storing history information regarding the operation modes, and an application quantity determining unit for determining whether or not an application quantity of each of other operation modes exceeds an established reference application quantity, based on the history information stored in the storage unit. In addition, the host apparatus comprises a display unit for displaying a purport that an application quantity of each of other operation modes exceeds a reference, when the application quantity determining unit determines that the application quantity exceeds the reference application quantity.

According to a fifth aspect of the invention, there is provided a method of controlling an image forming apparatus according to the present invention, in which at least one replaceable unit is replaceably mounted to an image forming apparatus main body. The method comprises a step of selecting any one of an operation mode corresponding to the replaceable unit which is a genuine article and other operation modes different from the operation mode, according to a request of a user, a step of performing controls according to the selected operation mode, and a step of storing history information regarding the operation modes.

In addition, the operation mode mentioned herein means aspects of control of an image forming apparatus, and includes not only programs and control parameters for forming an image, but also input and output conditions, and further includes aspects of display onto a display device, which are not directly related to the image formation.

According to the present invention, a replaceable unit other than a genuine article can be used by the user's intention, even when the replaceable unit other than a genuine article is mounted. Further, mounting histories the replaceable unit and histories of an operation mode to be applied when the replaceable unit is mounted can be managed.

BRIEF DESCRIPTION OF THE DRAWINGS

These and other objects and advantages of this invention will become more fully apparent from the following detailed description taken with the accompanying drawings in which:

FIGS. 14A to 14C are diagrams exemplarity showing history information which is managed in the image forming apparatus 10;

FIGS. 17A and 17B is a graph showing results corrected by the setting shown in FIG. 16, in which FIG. 17A shows a corrected toner density and FIG. 17B shows a corrected image density;

FIGS. 22A and 22B are diagrams exemplarily showing a screen displayed on a UI device, in which FIG. 22A shows an operation mode selection screen corresponding to a genuine article, and FIG. 22B shows an operation mode selection screen corresponding to a non-genuine article;

FIG. 24 is a diagram exemplarily showing a history display screen 299 which is displayed on the UI device 18.

DETAILED DESCRIPTION OF THE PREFERRED EMBODIMENTS

Hereinafter, embodiments of the present invention will be described with reference to the accompanying drawings.

Figure 1:
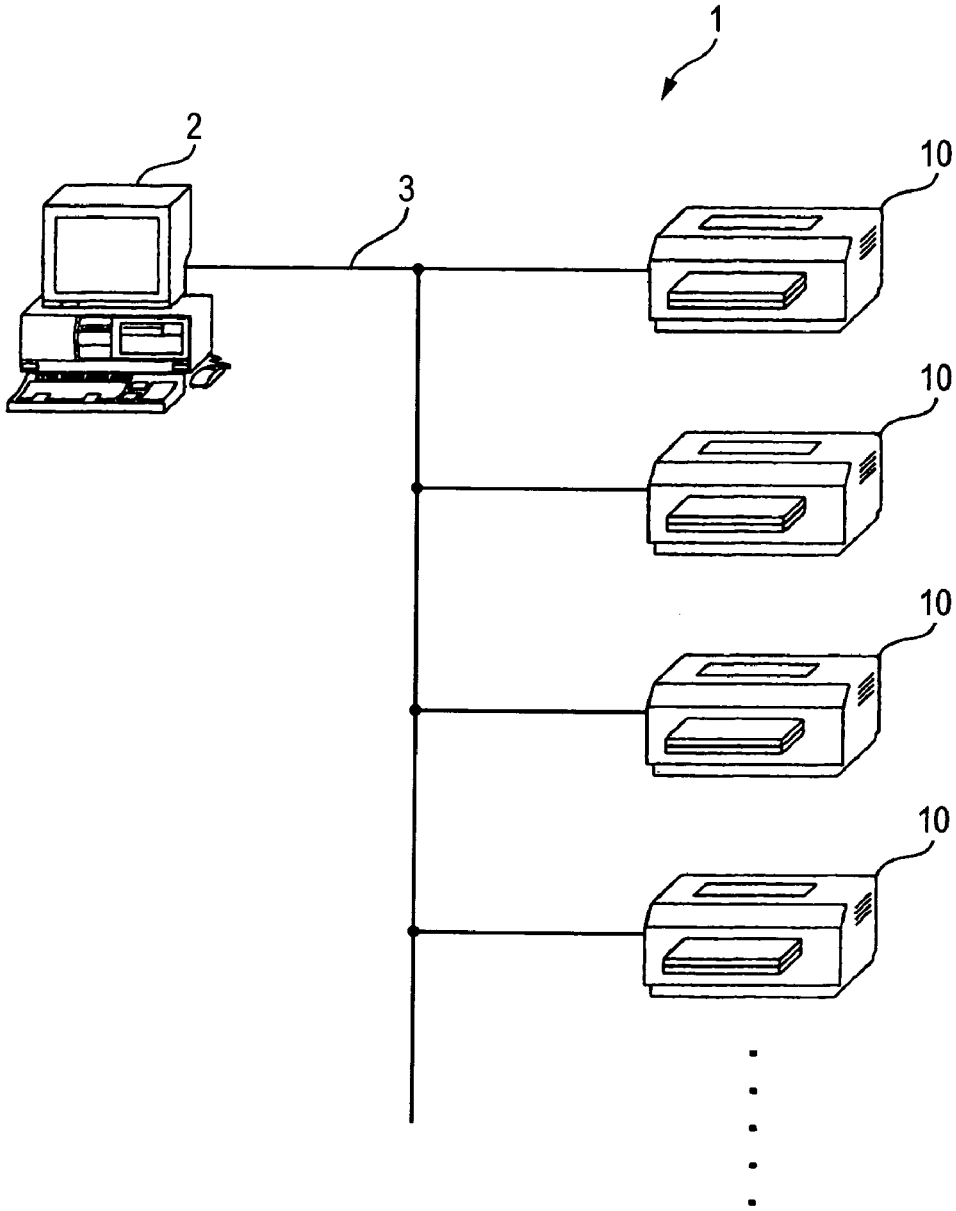
FIG. 1 is a schematic diagram of an image forming system according to an embodiment of the present invention.

FIG. 1 illustrates an image forming system 1 according to an embodiment of the present invention. The image forming system 1 is constructed by connecting a host apparatus 2, such as a personal computer (PC) to, for example, a plurality of image forming apparatuses 10 via a network 3. The host apparatus 2 may be a terminal having a control device, such as a micro controller unit (MCU), an input-output device, such as a touch panel, and a communication device for transmitting or receiving signals via the network 3, except the PC. The network 3 may be constructed by wire or wireless. Further, a plurality of the host apparatuses 2 may be connected to the network 3.

As such, the image forming system 1 is constructed such that the host apparatus 2 can control the image forming apparatuses 10 via the network 3.

Figure 2:
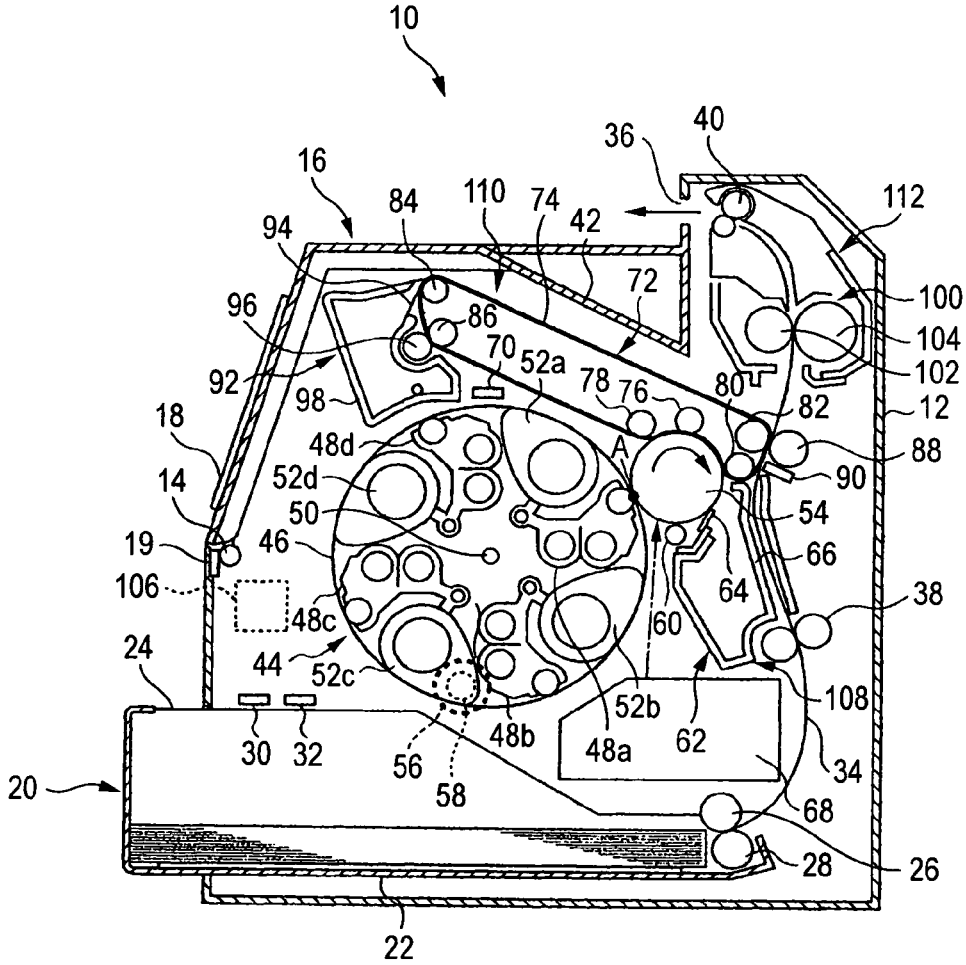
FIG. 2 is a side view schematically showing an image forming apparatus according to the embodiment of the present invention.

FIG. 2 schematically illustrates an image forming apparatus 10. The image forming apparatus 10 has an image forming apparatus main body 12, and an opening and closing cover 16 is provided at an upper portion of the image forming apparatus main body 12 to rotate about a fulcrum 14. A user interface device (UI device) 18, such as a touch panel, is provided on the front side (the left side in FIG. 2) of the opening and closing cover 16. The UI device 18 displays control information or instruction information of the image forming apparatus 10, and the instruction information from a user is input to the UI device 18. That is, a user can operate the image forming apparatus 10 via the UI device 18. Meanwhile, the UI device 18 may be a device for performing only the input of signals, such as a switch, or may be a device for receiving only the output of signals, such as display. Otherwise, the UI device 18 may be a combined device for performing both the input and output of signals.

Further, an opening and closing detecting sensor 19 is provided in the vicinity of the fulcrum 14 to detect the opening or closing of the opening and closing cover 16 by contact or separation according to opening or closing of the opening and closing cover 16.

For example, one-stage sheet feeding unit 20 is provided at a lower portion of the image forming apparatus main body 12. The sheet feeding unit 20 has a sheet feeding unit main body 22 and a sheet feeding cassette 24 for receiving sheets. A feeding roller 26 for feeding sheets from the sheet feeding cassette 24 and a retard roller 28 for separating the fed sheets one by one are arranged at the upper portion of the vicinity of a rear end of the sheet feeding cassette 24. Further, a temperature sensor 30 for detecting the temperature in the image forming apparatus main body 12 and a humidity sensor 32 for detecting the humidity in the image forming apparatus main body 12 are provided above the sheet feeding cassette 24.

A conveying path 34 is a sheet conveying path from the feeding roller 26 to a discharge port 36, and the conveying path 34 is formed substantially vertically from the sheet feeding unit 20 to a fixing device 100, which will be described later, in the vicinity of the rear side (the right side in FIG. 2) of the image forming apparatus main body 12. A secondary transfer roller 88 and a secondary transfer backup roller 82, which will be described later, are arranged upstream of the fixing device 100 in the conveying path 34, and a resist roller 38 is arranged downstream of the secondary transfer roller 88 and the secondary transfer backup roller 82. Further, a discharge roller 40 is arranged in the vicinity of the discharge port 36 in the conveying path 34.

Accordingly, the sheets fed by the feeding roller 26 from the sheet feeding cassette 24 of the sheet feeding unit 20 are separated by the retard roller 28, and only the topmost sheet is guided to the conveying path 34. Then, the conveyance of the guided sheet is temporally stopped by the resist roller 38, and the sheet passes between the secondary transfer roller 88 and the secondary transfer backup roller 82, which will be described later, at a predetermined timing, so that a toner image is transferred onto the sheet. Subsequently, the transferred toner image is fixed by the fixing device 100, and the sheet is then discharged by the discharge roller 40 from the discharge port 36 to a discharge section 42 provided on the upper side of the opening and closing cover 16. The discharge section 42 slopes gradually downward from the front side (the left side in FIG. 2) thereof toward the discharge port.

A developer container unit 44, such as a rotary developing device, is arranged, for example, substantially at the center of the image forming apparatus main body 12. The developer container unit 44 has a developer container unit main body 46, and the developer container unit main body 46 is mounted with four developer containers 48*a* to 48*d* for forming a toner image. These developer containers 48*a* to 48*d* rotate left (in the counterclockwise direction in FIG. 2) about a rotating shaft 50 with the developer container unit main body 46. The developer containers 48*a* to 48*d* are mounted with tubular toner cartridges 52*a* to 52*d* for containing toners of yellow (Y), magenta (M), cyan (C), and black (K), respectively. When the toner cartridges 52*a* to 52*d* are mounted in the developer container unit main body 46 through the developer containers 48*a* to 48*d*, the toner cartridges 52*a* to 52*d* are mounted such that their outer surfaces almost coincide with the outer circumference of the developer container unit main body 46.

An image carrier 54 made of, for example, a photoreceptor is arranged so as to abut on the developer container unit 44 from the rear side (the right side in FIG. 2) of the image forming apparatus 10. Specifically, four colors of Y, M, C, and K are prepared in the developer container unit 44 to perform full color development, and the developer containers 48*a* to 48*d* are rotated and positioned at positions to face the image carrier 54 and then develop a latent image on the image carrier 54, using the toners of respective colors of yellow (Y), magenta (M), cyan (C) and black (B), sequentially.

Further, a wireless communication unit 56 is arranged in the vicinity of a position substantially opposite to the image carrier 54 with respect to the rotating shaft 50 of the developer container unit 44. The wireless communication unit 56 has an antenna 58 and communicates with memory chips 170, which will be described later, by wireless.

Further, an electrifying device 60 including, for example, an electrifying roller, is provided below the image carrier 54 for uniformly electrifying the image carrier 54. Further, an image carrier cleaner 62 abuts on the image carrier 54 upstream of the electrifying device 60 in the rotating direction of the image carrier 54. The image carrier cleaner 62 includes a cleaning blade 64 for scraping off a toner remaining on the image carrier 54 after a primary transfer and a waste toner collecting bottle 66 for collecting the toner scraped off by the cleaning blade 64.

Meanwhile, for example, ribs are formed on the rear side (the right side in FIG. 2) of the waste toner collecting bottle 66, and the rear surface of the waste toner collecting bottle 66 is formed into a curved surface such that sheets can be smoothly conveyed. Further, the rear surface of the waste toner collecting bottle 66 constitutes a portion of the conveying path 34.

Further, an exposure device 68 for writing a latent image on the image carrier 54 electrified by the electrifying device 60, using light rays, such as laser beam, is provided below the rear side of the developer container unit 44. Further, an unused state detecting sensor 70, such as a reflective photosensor, for detecting whether the toner cartridges 52*a* to 52*d* mounted in the developer container unit 44 are unused, is provided above the developer container unit 44. An intermediate transfer device 72 is provided above the developer container unit 44 and the unused state detecting sensor 70. The intermediate transfer device 72 primarily transfers the toner image visualized by the developer container unit 44 for each color at a primary transfer position whenever an intermediate transfer body 74 makes one rotation such that the toner image having four colors are superposed on the intermediate transfer body 74, and then collectively transfers the toner image on a sheet at a secondary transfer position which will be described later.

The intermediate transfer device 72 includes an intermediate transfer body 74, such as an intermediate transfer belt, a primary transfer roller 76, a lap-in roller 78, a lap-out roller 80, a secondary backup roller 82, a scraper backup roller 84, and a brush backup roller 86. The intermediate transfer body 74 has, for example, elasticity, and is substantially flatly stretched such that it has long sides and short sides above the developer container unit 44. The upper long side of the intermediate transfer body 74 is stretched such that it is substantially parallel to the discharge section 42 provided on the upper side of the image forming apparatus main body 12. Further, the intermediate transfer body 74 has a primary transfer section (an image carrier lap region) to abut on the image carrier 54 in the shape of a lap between the lap-in roller 78 arranged upstream of the primary transfer roller 76 at the lower long side thereof, and the lap-out roller 80 arranged downstream of the primary transfer roller 76. Also, the intermediate transfer body 74 is wound around the image carrier 54 by a predetermined range to follow the rotation of the imager carrier 54.

Moreover, a planar surface (a short side) is formed at the rear side (the right side in FIG. 2) of the intermediate transfer body 74 by the lap-out roller 80 and the secondary transfer backup roller 82. The planar surface forms a secondary transfer section so as to face the conveying path 34.

As such, a toner image on the image carrier 54 is repeatedly and primarily transferred onto the intermediate transfer body 74 in order of, for example, yellow, magenta, cyan and black by the primary transfer roller 76, and the primarily transferred toner image is then carried toward the secondary transfer section.

The scraper backup roller 84 assists a scraper 94, which will be described later, in scraping off a toner remaining on the intermediate transfer body 74 after the secondary transfer, and the brush backup roller 86 assists a brush roller 96, which will be described later, in scraping off a toner remaining on the intermediate transfer body 74 after the secondary transfer.

The secondary transfer roller 88 and the secondary transfer backup roller 82 of the intermediate transfer device 72 face each other with the conveying path 34 interposed therebetween. Specifically, a position between the secondary transfer roller 88 and the secondary transfer backup roller 82 becomes a secondary transfer position in the secondary transfer section, and the secondary transfer roller 88 secondarily transfers the toner image primarily transferred onto the intermediate transfer body 74 onto a sheet at the secondary transfer position by the assistance of the secondary transfer backup roller 82. Here, the secondary transfer roller 88 is separated from the intermediate transfer body 74 while the intermediate transfer body 74 rotates three times, i.e., while toner images having three colors of yellow, magenta and cyan, respectively, are carried, whereas the secondary transfer roller 88 abuts on the intermediate transfer body 74 when the black toner image has been transferred. Meanwhile, there is a predetermined potential difference between the secondary transfer roller 88 and the secondary transfer backup roller 82. For example, when the secondary transfer roller 88 has a high voltage, the secondary transfer backup roller 82 is connected to a ground (GND) or the like.

Upstream of the secondary transfer position, an image density sensor 90, such as a reflective photosensor, is arranged opposite to the intermediate transfer body 74 with the conveying path 34 interposed therebetween. The image density sensor 90 reads out a patch of a toner formed on the intermediate transfer body 74, and detects the density of the image formed on the intermediate transfer body 74.

A cleaner 92 for an intermediate transfer body is provided to abut on an end of the intermediate transfer body 74 opposite to the image carrier. The cleaner 92 for an intermediate transfer body includes, for example, a scraper 94 which scrapes and cleans a toner remaining on the intermediate transfer body 74 after the secondary transfer, a brush roller 96 which further scrapes a toner remaining after the cleaning by the scraper 94, and a waste toner collecting bottle 98 which collects the toner scraped by the scraper 94 and the brush roller 96. The scraper 94 is made of, for example, a stainless thin plate. A voltage having polarity reverse to that of the toner is applied to the scraper 94. The brush roller 96 has, for example, a brush such as acryl subjected to conductive treatment. Further, while the intermediate transfer body 74 carries a toner image, the scraper 94 and the brush roller 96 are separated from the intermediate transfer body 74, whereas they are integrated with each other at a predetermined timing so as to abut on the intermediate transfer body 74.

A fixing device 100 is arranged above the secondary transfer position. The fixing device 100 has a heating roller 102 and a pressing roller 104, fixes a toner image secondarily transferred onto a sheet by the secondary transfer roller 88 and the secondary transfer backup roller 82 on the sheet, and conveys the sheet toward the discharge roller 40.

Further, a control unit 106 is arranged in the image forming apparatus main body 12 for controlling respective parts that constitute the image forming apparatus 10.

An image carrier unit 108 is constructed by integrating the image carrier 54, the electrifying device 60, and the image carrier cleaner 62 with each other. Further, an image forming unit 110 is constructed by integrating the image carrier unit 108, the intermediate transfer device 72 and the cleaner 92 for an intermediate transfer body with each other. Moreover, a fixing unit 112 is constructed by integrating the fixing device 100 and the discharge roller 40 with each other.

Figure 3:
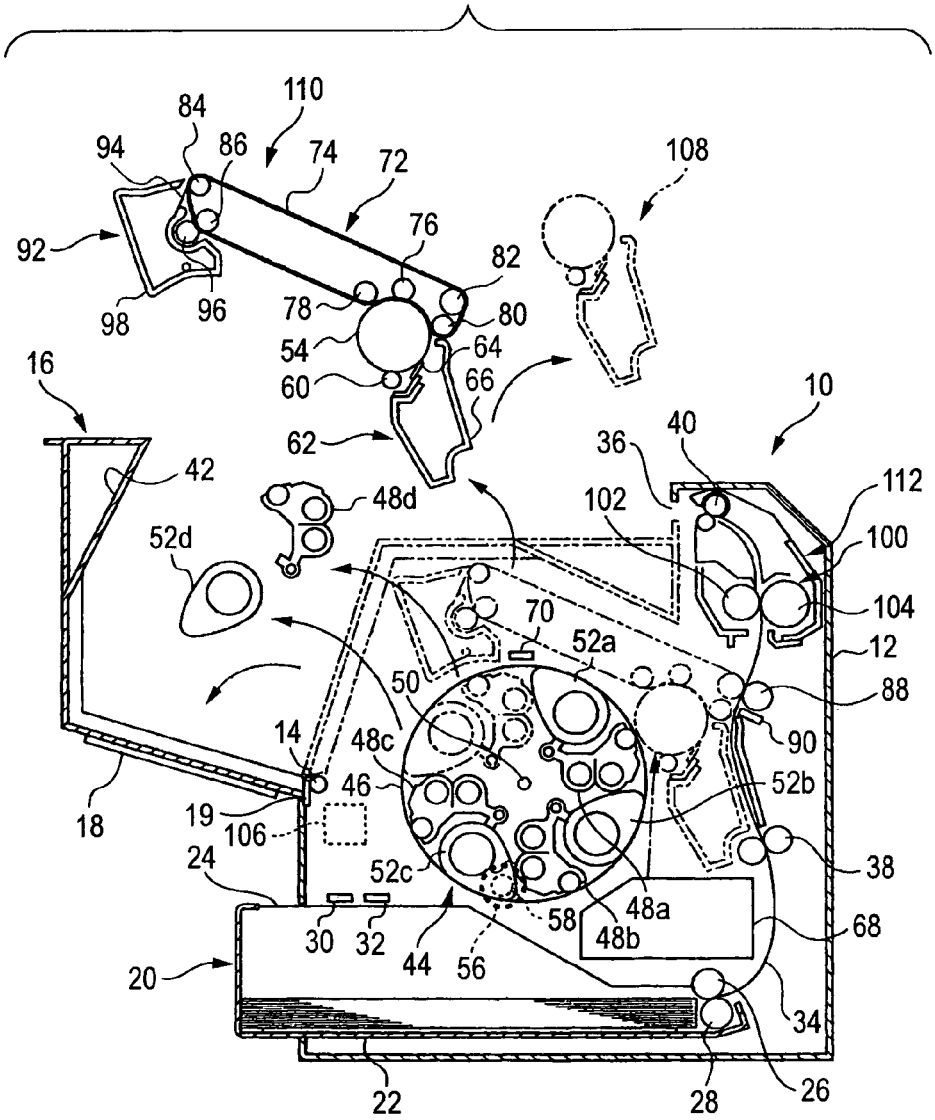
FIG. 3 is a side view exemplarily showing a state in which replaceable units of the image forming apparatus according to the embodiment of the present invention are detached from an image forming apparatus main body.

As also illustrated in FIG. 3, the image forming unit 110 is adapted to be attachable to or detachable from the image forming apparatus main body 12, and is attached to or detached from the image forming apparatus main body by opening the opening and closing cover 16. Further, the image carrier unit 108 is adapted to be attachable to or detachable from the image forming unit 110.

When the opening and closing cover 16 is opened and the toner cartridges 52*a* to 52*d* are positioned on the front side (on the side of the opening and closing cover 16), the toner cartridges 52*a* to 52*d* are adapted to be attachable to or detachable from the developer containers 48*a* to 48*d* mounted in the developer container unit main body 46. When the opening and closing cover 16 is opened and the developer containers 48*a* to 48*d* are located on the front side (on the side of the opening and closing cover 16), the developer containers 48*a* to 48*d* are adapted to be attachable to or detachable from the developer container unit main body 46.

The fixing unit 112 is adapted to be attachable to or detachable from the image forming apparatus main body 12 by detaching a top cover (not shown). Further, other units, such as the developer container unit 44 and the sheet feeding unit 20, are adapted to be attachable to or detachable from the image forming apparatus main body 12.

As such, the respective units can be replaced by a user. On the other hand, in case a user mounts a replaceable unit in the image forming apparatus 10, if the replaceable unit is any one other than a genuine article for the image forming apparatus 10, a problem occurs in that good image quality cannot be maintained and the operation cannot be guaranteed. This is because the image forming apparatus 10 is controlled in accordance with the characteristics of members used for the image forming apparatus 10. Thus, units replaceable by a user are provided with sensors that detect predetermined conditions.

Hereinafter, if any one of a plurality of components, such as the developer containers 48*a* to 48*d*, is not specified, the developer containers are abbreviated as, simply, a "developer container 48".

Next, examples of replaceable units having sensors for detecting predetermined conditions will now be described.

Figure 4:
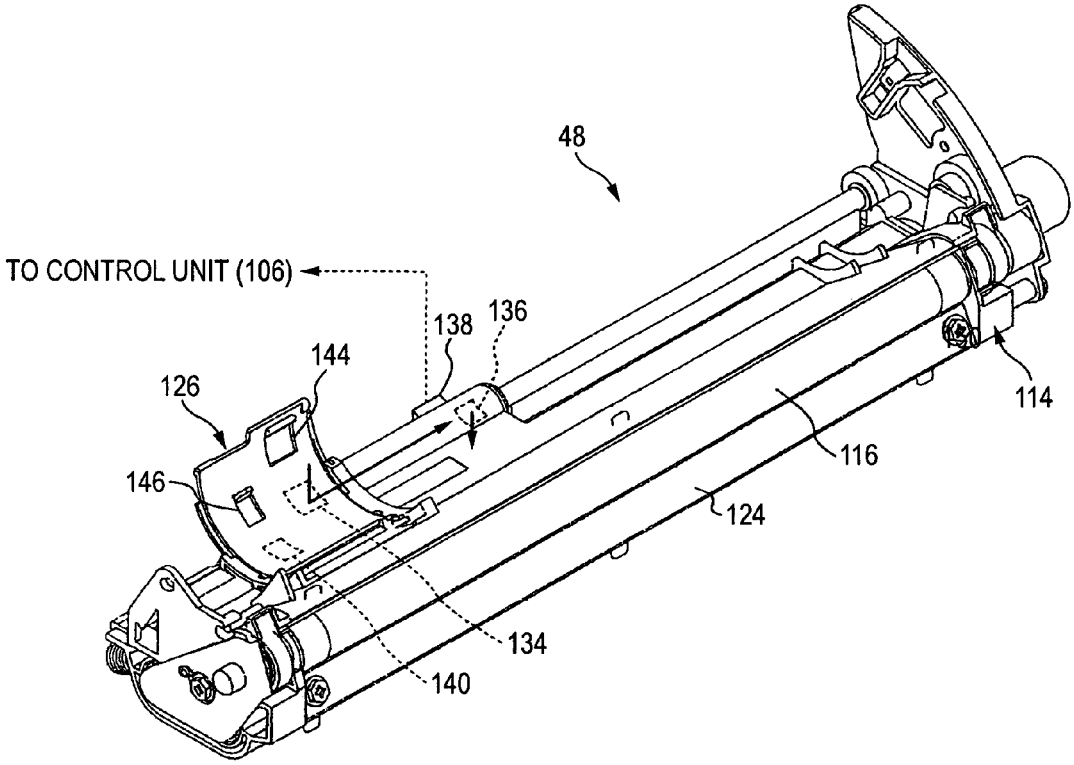
FIG. 4 is a perspective view showing a developer container of the image forming apparatus according to the embodiment of the present invention.
Figure 5:
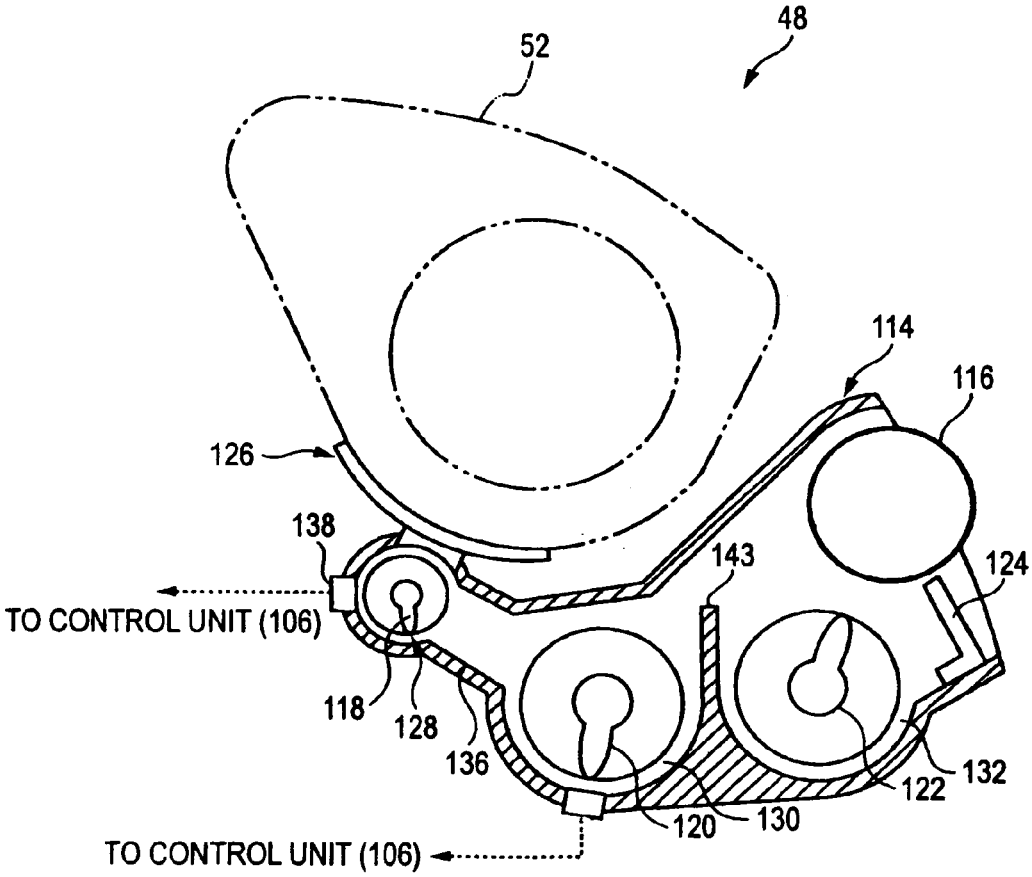
FIG. 5 is a schematic view showing a cross-section of the developer container of the image forming apparatus according to the embodiment of the present invention.

FIGS. 4 and 5 illustrate a construction of a developer container 48 that is a replaceable unit.

The developer container 48 has a developing roller 116 serving as a developer carrier arranged on the image carrier 54 side of a developer container housing (a developer container main body) 114, a first auger 118, a second auger 120, a third auger 122, and a layer thickness regulating member 124. The developer container 48 also contains, for example, a two-component developer consisting of a non-magnetic toner and a magnetic carrier.

The developer container housing 114 has a shutter 126 for opening or closing a toner receiving port 134 and a developer discharge port 140, which will be described later, a tubular take-in conveying path 128 for conveying a toner taken in from the toner cartridge 52, and tubular developer conveying paths 130 and 132 for agitating and conveying a toner and a carrier.

The take-in conveying path 128 has a toner receiving port 134 for receiving a toner from the toner cartridge 52, and a toner feeding port 136 for feeding a toner to the developer conveying path 130. The first auger 118 is arranged in the take-in conveying path 128. The first auger 118 conveys a toner received from the toner cartridge 52 by the take-in conveying path 128, to the developer conveying path 130. Further, the rotation of the first auger 118 is regulated so that the amount of a toner supplied to the developer container 48 from the toner cartridge 52 can be regulated. Thus, a CPU 202 may cumulate the driving time and revolution number of the first auger 118 such that the consumption of a toner (the consumption of the toner cartridge 52) can be calculated. Further, the consumption of a toner may be calculated by storing, as electric charges, currents flowing through the image carrier 54 to a carrier and the like when the exposure device 68 writes an electrostatic latent image in the image carrier 54, and then by allowing the CPU 202 to count the number of times by which the stored electric charges reaches a predetermined amount.

A toner presence/absence detecting sensor 138 is provided in the take-in conveying path 128 between the toner receiving port 134 and the toner feeding port 136. The toner presence/absence detecting sensor 138 detects the presence or absence of a toner in the take-in conveying path 128, for example, by detecting a change in a resistance value depending on the presence or absence of a toner between two points in the take-in conveying path 128. Further, the toner presence/absence detecting sensor 138 may be a piezoelectric element.

The developer conveying path 130 has a developer discharge port 140 for discharging a surplus developer to the toner cartridge 52, and the second auger 120 is arranged in the developer conveying path 130. The second auger 120 agitates a toner conveyed through the take-in conveying path 128, and a carrier, and conveys the resulting mixture to the developer conveying path 132.

The third auger 122 is arranged in the developer conveying path 132. The third auger 122 agitates and conveys a developer through the developer conveying path 130, and supplies the resultant to the developing roller 116.

Meanwhile, a partition plate 143 is provided between the developer conveying path 130 and the developer conveying path 132. Passageways (not shown) are provided at both ends of the partition plate 143 for connecting the developer conveying path 130 and the developer conveying path 132. Thus, the second auger 120 and the third auger 122 convey a developer in directions different from each other so that a toner can be frictionally electrified so as to have predetermined polarity and electric charge quantity by the carrier and can be circulated in the developer container housing 114. Further, a deteriorated developer is discharged to the toner cartridge 52 from the developer discharge port 140 at a predetermined timing so that the total lifetime of the developer can be prolonged (a trickle development method).

The shutter 126 has openings 144 and 146. The opening 144 is overlapped with the toner receiving port 134 to form a passageway for a toner from the toner cartridge 52 to the developer container 48, and the opening 146 is overlapped with the developer discharge port 140 to form a passageway for a surplus developer from the developing container 48 to the toner cartridge 52.

The developing roller 116 abuts on the image carrier 54 while carrying a toner, thereby developing an electrostatic latent image carried by the image carrier 54 with the toner. The layer thickness regulating member 124 regulates the layer thickness of a toner carried by the developing roller 116.

Figure 6:
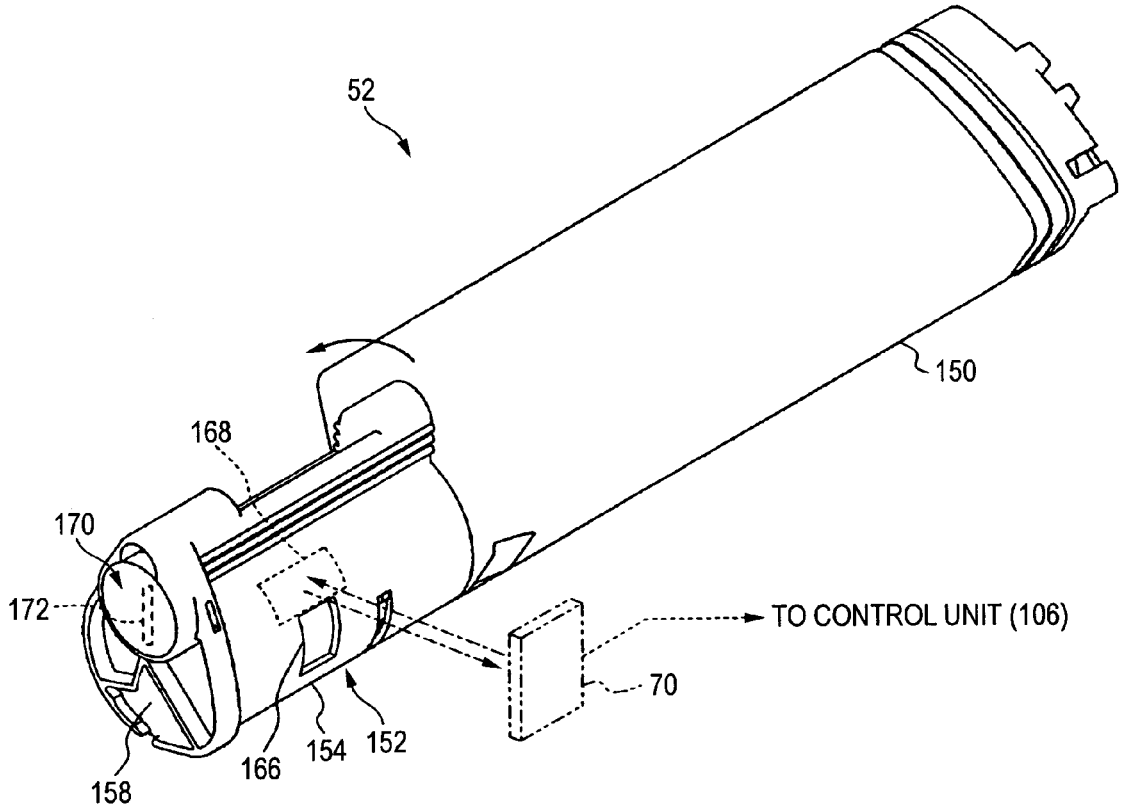
FIG. 6 is a perspective view showing a toner cartridge of the image forming apparatus according to the embodiment of the present invention.
Figure 7:
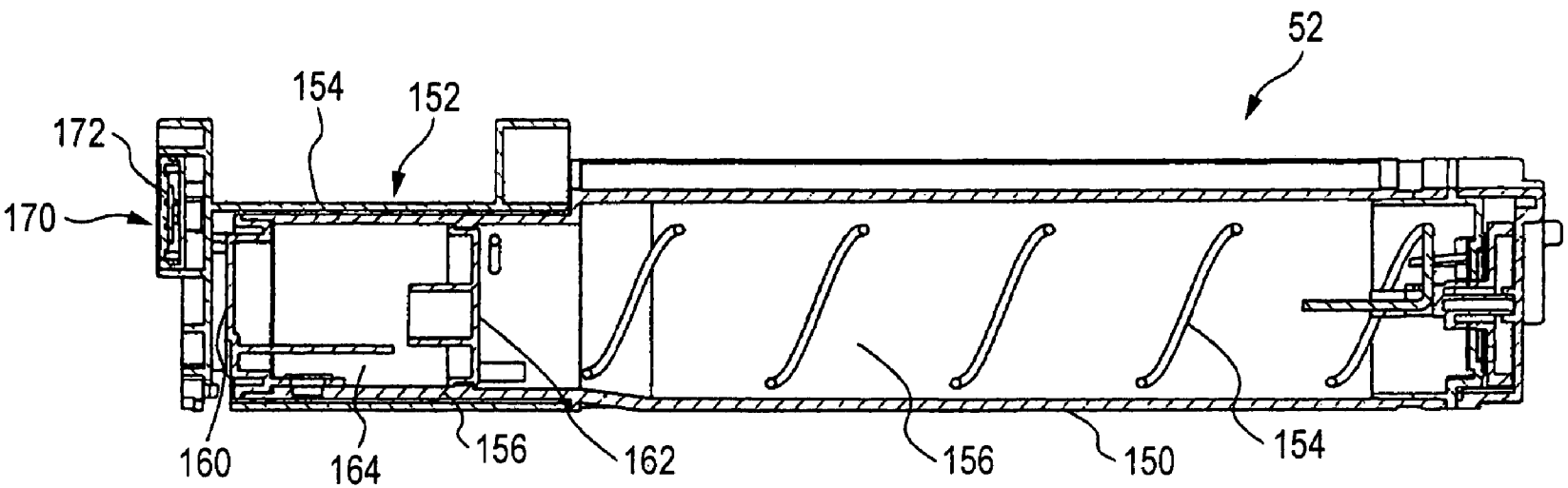
FIG. 7 is a cross-sectional view showing of the toner cartridge of the image forming apparatus according to the embodiment of the present invention.

FIGS. 6 and 7 illustrate a construction of the toner cartridge 52 that is a replaceable unit.

The toner cartridge 52 has a toner cartridge main body 150, and a rotating member 152 provided at a longitudinal end of the toner cartridge main body 150.

The toner cartridge main body 150 is formed in a tubular shape, and is formed such that a substantially cylindrical portion having an agitating and conveying member (i.e., rotating member main body) 154 arranged therein and a portion extending from the substantially tubular portion in a direction substantially perpendicular to its longitudinal direction so as to be gradually narrowed are integrated with each other. Further, when the toner cartridge 52 is mounted in the developer container unit main body 46 via the developer container 48, the toner cartridge main body 150 is configured such that its outer surface substantially coincides with the outer circumference of the developer container main body 46.

A toner accommodating space (i.e., tubular portion) 156 is formed in the toner cartridge main body 150 for accommodating a toner to be supplied to the developer container 48. The above-mentioned agitating and conveying member 154 is provided in the toner accommodating space 156. The agitating and conveying member 154 is wound in, for example, a spiral shape, and agitates a toner in the toner accommodating space 156 and conveys the agitated toner toward the toner receiving port 134 of the developer container 48.

The rotating member 152 has a rotating member main body 154, and a cylindrical tubular part 156 provided in the rotating member main body 154 and integrally formed with the toner cartridge main body 150. The tubular part 156 is sealed up at a lateral face 158 of the rotating member main body 154 by a tubular part sidewall 160, and has an isolating wall 162 provided therein. A developer collecting space 164 for collecting a surplus developer from the developer container 48 is formed at the side of the isolating wall 162 facing the tubular part sidewall 160, and the above-mentioned toner accommodating space 156 is formed to extend at the side of the isolating wall 162 opposite to the tubular part sidewall 160.

The rotating member main body 154 has a window 166 covered with a transparent member, and has the inner surface thereof formed in a cylindrical shape to rotate along the outer surface of the cylindrical portion of a tubular part 156. Further, a reflecting member 168, such as a white tape, is attached to the outer surface of the cylindrical portion of the tubular part 156. When the toner cartridge 52 is mounted in the developer container 48 and the rotating member main body 154 rotates, the reflecting member 168 is exposed through the window 166. Further, when the developer container unit 44 having the toner cartridge 52 mounted therein rotates in the image forming apparatus main body 12, the exposed reflecting member 168 passes through a position which faces the unused state detecting sensor 70 fixed to the image forming apparatus main body 12. As described above, the unused state detecting sensor 70 is, for example, a reflective photosensor. When the reflecting member 168 of the toner cartridge 52 mounted in the developer container unit 44 passes through a position which faces the unused state detecting sensor 70, the unused state detecting sensor 70 detects the quantity of reflection of the reflecting member 168 which varies depending on dirt by a toner, thereby detecting whether or not the toner cartridge 52 is unused.

A memory chip 170 is attached to the lateral face 158 of the rotating member main body 154. The memory chip 170 has an antenna 172, and performs wireless communication with the wireless communication unit 56 provided on the image forming apparatus main body 12.

Next, regarding the wireless communication unit 56 and the memory chip 170, a circuit configuration of each thereof and communication performed therebetween will now be described.

Figure 8:
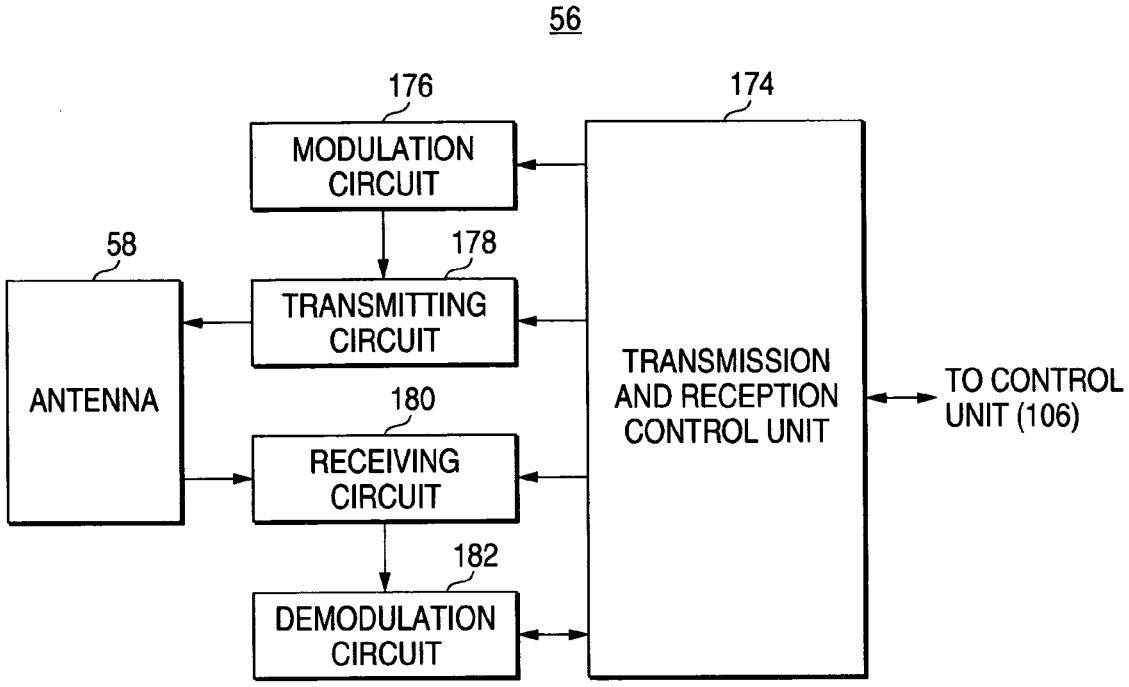
FIG. 8 is a block diagram showing a circuit configuration of a wireless communication unit of the image forming apparatus according to the embodiment of the present invention.
Figure 9:
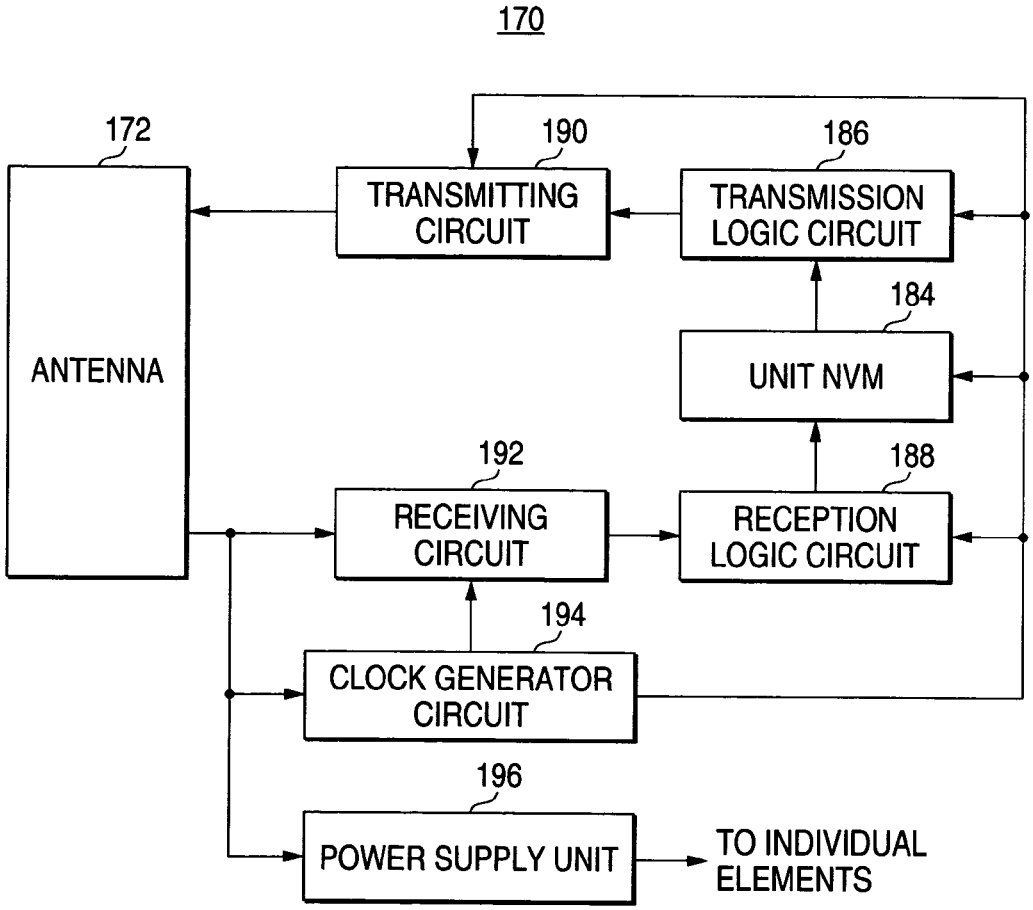
FIG. 9 is a block diagram showing a circuit configuration of a memory chip of a toner cartridge used for the image forming apparatus according to the embodiment of the present invention.

FIG. 8 is a block diagram showing a circuit configuration of the wireless communication unit 56. FIG. 9 is a block diagram showing a circuit configuration of the memory chip 170.

As illustrated in FIG. 8, a circuit of the wireless communication unit 56 includes a transmission and reception control unit 174, a modulation circuit 176, a transmitting circuit 178, a receiving circuit 180, a demodulation circuit 182, and an antenna 58. In the wireless communication unit 56, the transmission and reception control unit 174 controls the operation of the respective components of the wireless communication unit 56. Also, the transmission and reception control unit 174 outputs data input from the control unit 106 to the demodulation circuit 176. Further, the transmission and reception control unit 174 outputs data received by the receiving circuit 180 and demodulated by the demodulation circuit 182 to the control unit 106. The modulation circuit 176 modulates data input from the transmission and reception control unit 174 and outputs the modulated data to the transmitting circuit 178. The transmitting circuit 178 outputs radio signals, including data and clock signals to be stored in the memory chip 170, to the memory chip 170 via the antenna 58.

The receiving circuit 180 receives signals transmitted from the memory chip 170 via the antenna 58, and outputs the received signals to the demodulation circuit 182. The demodulation circuit 182 demodulates data transmitted by the memory chip 170 depending on a change in the signals input from the receiving circuit 180, and outputs the demodulated data to the transmission and reception control unit 174.

As illustrated in FIG. 9, a circuit of the memory chip 170 includes a unit nonvolatile memory (NVM) 184, a transmission logic circuit 186, a reception logic circuit 188, a transmitting circuit 190, a receiving circuit 192, a clock regenerator circuit 194, a power supply unit 196, and an antenna 172.

When radio signals are transmitted from the wireless communication unit 56 to the memory chip 170, the receiving circuit 192, the clock regenerator circuit 194 and the power supply unit 196 receive the radio signals via the antenna 172. In the memory chip 170, when the radio signals were received, the power supply unit 196 rectifies a current caused by the electromagnetic induction by the radio signals, and supplies electric power required for the operation of the respective components of the memory chip 170 to the components. For example, when a voltage higher than that generated by the power supply unit 196 is required, the memory chip 170 may be configured to receive the power supplied from the main body 40. For example, power may be supplied in a non-contact way from an alternating current supplied to the developer container unit 44 by further providing the memory chip 170 with power supply coils or the like.

When the clock regenerator circuit 194 receives the radio signals, it regenerates clock signals and outputs the regenerated clock signals to the respective circuits which constitute the memory chip 170. When the receiving circuit 192 receives the radio signals, it outputs signals, such as data included in the radio signals, to the reception logic circuit 188 in synchronization with the clock signals input from the clock regenerator circuit 194. The reception logic circuit 188 demodulates signals, such as data input from the receiving circuit 192, in synchronization with the clock signals input from the clock regenerator circuit 194, and outputs the demodulated signals to the unit NVM 184.

The unit NVM 184 is a writable nonvolatile memory. When signals input from the reception logic circuit 188 in synchronization with the clock signals input from the clock regenerator circuit 194, indicate write-in of data, the unit NVM 184 performs write-in (storing) of the data, and when the signals indicate readout of data, the unit NVM 184 outputs the data stored in the unit NVM 184 to the transmission logic circuit 186. A nonvolatile memory included in the unit NVM 184 may be, for example, a flash read-only memory (flash ROM), an electrically erasable programmable read-only memory (EEPROM), or a ferroelectric random access memory (FeRAM).

The transmission logic circuit 186 modulates data input from the unit NVM 184 in synchronization with the clock signals input from the clock regenerator circuit 194, and outputs the modulated data to the transmitting circuit 190. The transmitting circuit 190 transmits the signals input from the transmission logic circuit 186 to the wireless communication unit 56 via the antenna 172 as radio signals, in synchronization with the clock signals input from the clock regenerator circuit 194.

Meanwhile, signals transmitted or received as the radio signals may be converted into radio signals after their encryption, and may then be transmitted or received. Further, for example, authorized users may rewrite the contents in the unit NVM 184 through any device other than the control unit 106, using encrypted radio signals.

Figure 10:
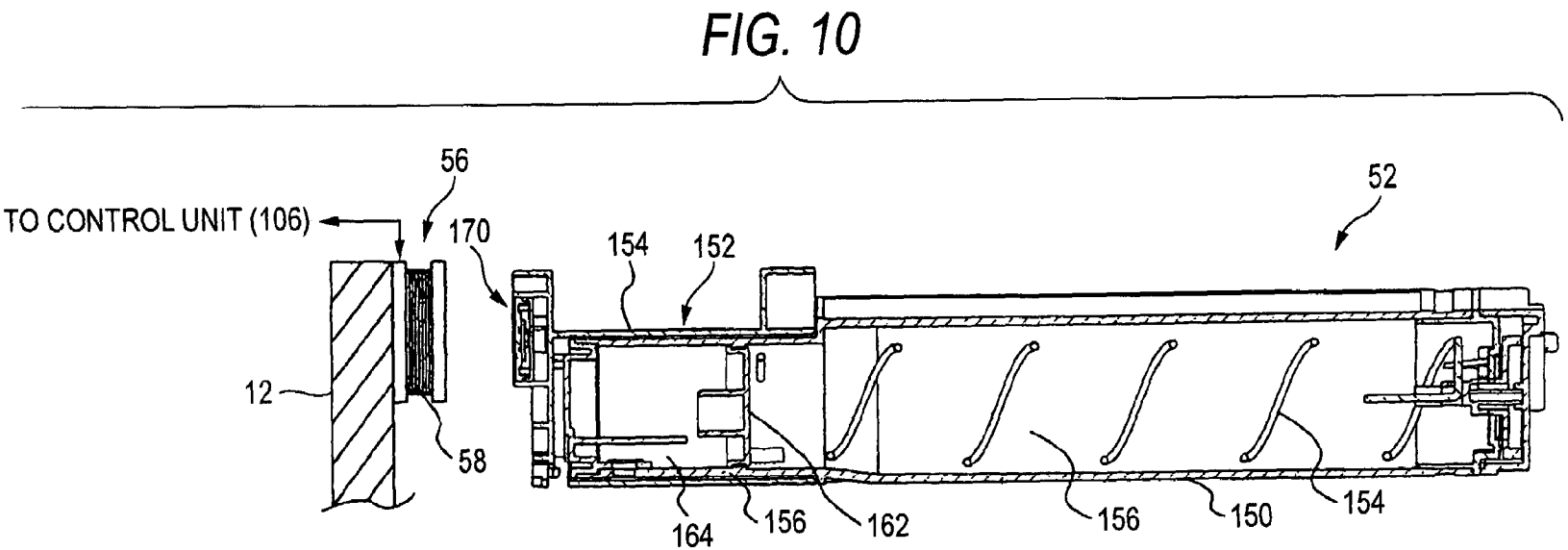
FIG. 10 is a cross-sectional view showing a positional relationship between the wireless communication unit and the memory chip which are performing wireless communication.

FIG. 10 illustrates a positional relationship between the wireless communication unit 56 and the memory chip 170 which perform wireless communication. As described above, the toner cartridge 52 is mounted in each developer container 48, and moves while the developer container unit 44 (FIG. 2) rotates about the rotating shaft 50. The wireless communication unit 56 is fixed to the image forming apparatus main body 12 in the vicinity of the lateral side of the developer container unit 44 so as to sequentially substantially face the memory chips 170 moved by the rotation of the developer container unit 44. The wireless communication unit 56 is also adapted to perform wireless communication in its halting state in which the movement of the developer container 48 is controlled at a position which substantially faces any one of the memory chips 170 so as to perform wireless communication with the facing memory chip 170. Further, the wireless communication unit 56 is adapted to receive acknowledge signals transmitted by the memory chip 170 in response to, for example, radio signals output by the wireless communication unit 56, so as to confirm the start of transmission or reception of data.

Figure 11:
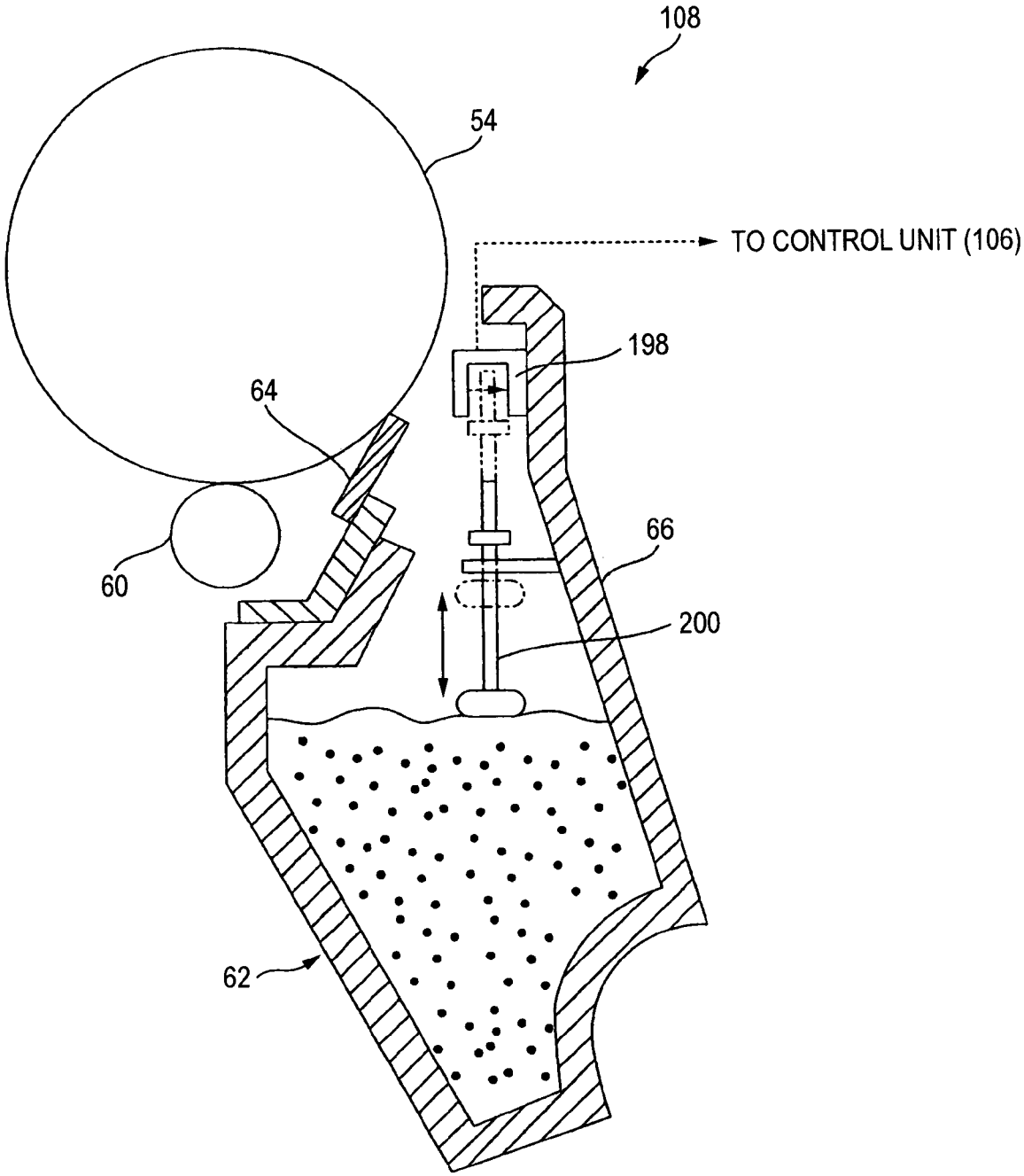
FIG. 11 is a side view showing a configuration of an image carrier unit used for the image forming apparatus according to the embodiment of the present invention.

FIG. 11 illustrates a configuration of the image carrier unit 108 that is a replaceable unit.

As describe above, the image carrier unit 108 is constructed by integrating the image carrier 54, the electrifying device 60 and the image carrier cleaner 62 with each other. For example, the image carrier unit 108 has a waste toner fullness sensor 198 arranged in the image carrier cleaner 62 at the upper portion thereof, and a float 200 arranged below the waste toner fullness sensor 198. The waste toner fullness sensor 198 has an optical path configured such that light emitted by a light-emitting part provided at one side is received by a light-receiving part provided at the other side, and outputs whether or not the light-receiving part has received the light, to the control unit 106. The float 200 is adapted to rise when a waste toner collected in the waste toner collecting bottle 66 from the image carrier 54 exceeds a predetermined amount, and is adapted to intercept the optical path of the waste toner fullness sensor 198 when the waste toner collecting bottle 66 is full of a waste toner. As such, the image carrier unit 108 detects whether or not the waste toner collecting bottle 66 becomes full by means of the waste toner fullness sensor 198 and the float 200, and outputs the detected result to the control unit 106.

Further, the waste toner fullness sensor 198 and the float 200 may be provided in the cleaner 92 for an intermediate transfer body to detect whether or not the waste toner collecting bottle 98 becomes full.

As such, a replaceable unit which has a sensor or the like for detecting predetermined conditions is adapted to output results detected by the sensor or the like to the control unit 106, and the control unit 106 controls the respective components which constitute the image forming apparatus 10 on the basis of the input detected results.

Moreover, the image carrier unit 108 may be provided with a memory chip. In this case, the image forming apparatus 10 is provided with a wireless communication unit (similar to the wireless communication unit 56 shown in FIG. 8) to be disposed in the vicinity of the memory chip provided in the image carrier unit 108. The memory chip provided in the image carrier unit 108 has the same configuration as that of the memory chip 170 shown in FIG. 9. Further, when the image carrier unit 108 is mounted to the image forming apparatus main body, the memory chip transmits or receives signals with the wireless communication unit under the control of the CPU 202.

Next, a construction of the control unit 106 will be described in detail.

Figure 12:
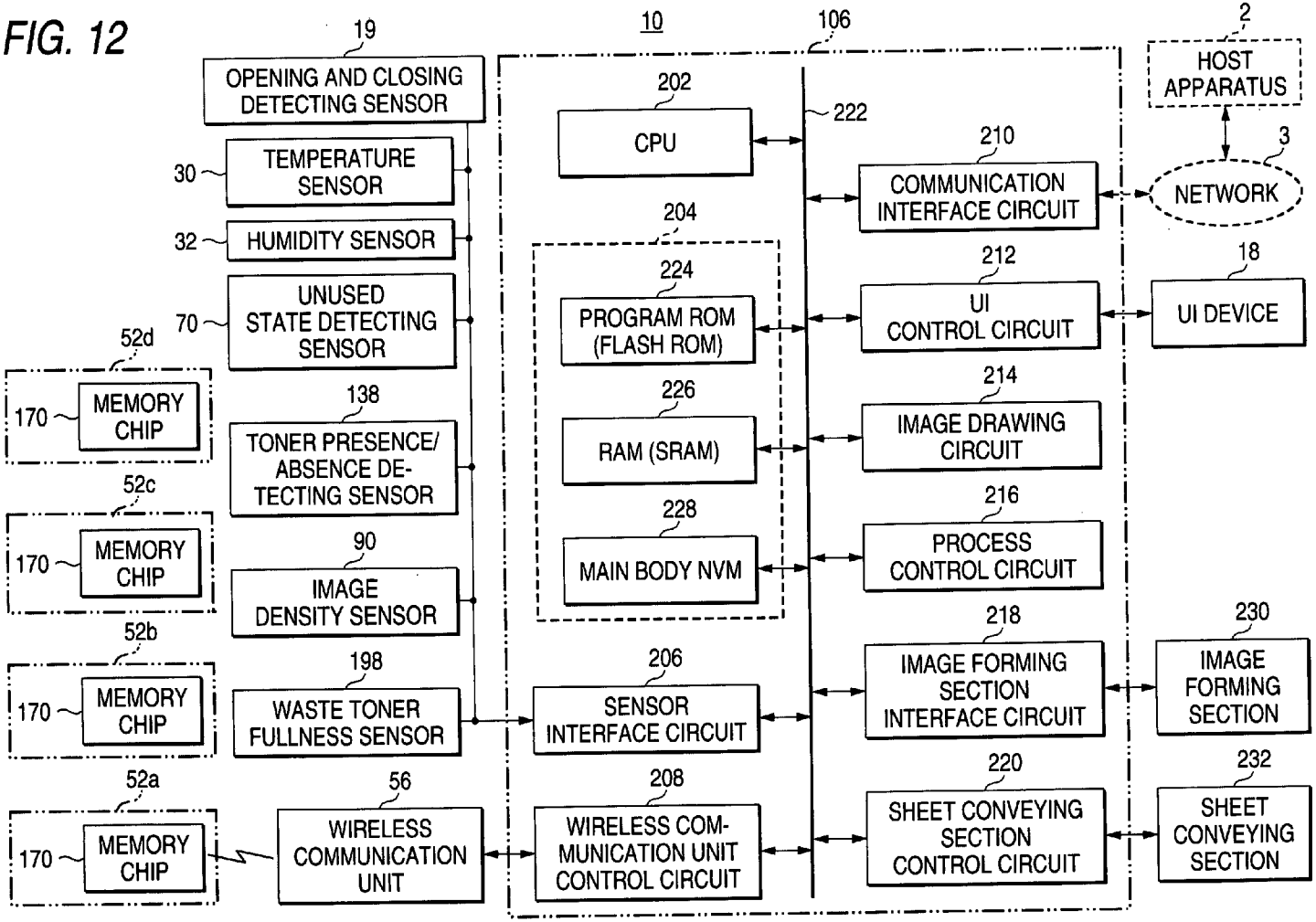
FIG. 12 is a block diagram showing a configuration of a control unit of the image forming apparatus according to the embodiment of the present invention, and respective elements connected to the control unit.

FIG. 12 is a block diagram showing a configuration of the control unit 106 and respective components connected to the control unit 106.

The control unit 106 has a CPU 202, a storage unit 204, a sensor interface (sensor I/F) circuit 206, a wireless communication unit control circuit 208, a communication interface (communication I/F) circuit 210, a user interface (UI) control circuit 212, an image drawing circuit 214, a process control circuit 216, an image forming section interface (image forming I/F) circuit 218, and a sheet conveying section control circuit 220. These components are configured to be capable of inputting or outputting signals via a system bus 222.

The CPU 202 transmits or receives signals between the respective components, which constitute the control unit 106, via the system bus 222, and controls the respective components which constitute the control unit 106.

The storage unit 204 has a program ROM 224, a RAM 226 and a main body nonvolatile memory (NVM) 228, and stores information required for controlling the image forming apparatus 10, and the like. The program ROM 224 may have, for example, a flash ROM, and the contents stored in the program ROM 224 may be updated. The RAM 226 may have, for example, an SRAM, and stores temporary information, such as drawing data inputted from the image drawing circuit 214. The main body NVM 228 has, for example, an electrically rewritable nonvolatile memory, such as an EEPROM or a flash ROM. Meanwhile, the main body NVM 228 is a rewritable storage device, and it may be an SRAM, a hard disc drive (HDD) or an optical memory whose power is backed up by, for example, a battery, as long as it can hold data even if the image forming apparatus 10 is powered off.

The sensor I/F circuit 206 receives results detected by the opening and closing detecting sensor 19, the temperature sensor 30, the humidity sensor 32, the unused state detecting sensor 70, the toner presence/absence detecting sensor 138, the image density sensor 90 and the waste toner fullness sensor 198, respectively, and outputs the detected results to the CPU 202 via the system bus 222. The wireless communication unit control circuit 208 transmits or receives signals with the four memory chips 170 respectively provided in the toner cartridges 52*a* to 52*d* via the wireless communication unit 56, transmits or receives signals with the CPU 202, the storage unit 204 and the like, via the system bus 222, and connects the respective memory chips 170 with the CPU 202, storage unit 204 and the like.

The communication I/F circuit 210 transmits or receives signals with the host apparatus 2 via the network 3, transmits or receives signals with the CPU 202 and the like via the system bus 222, and connects the host apparatus 2 with the CPU 202 and the like. The UI control circuit 212 transmits or receives signals with the UI device 18, transmits or receives signals with the CPU 202 and the like via the system bus 222, and connects the UI device 18 with the CPU 202 and the like.

The image drawing circuit 214 draws an image on the basis of image forming signals inputted from the host apparatus 2 or the like, and outputs the drawn image to the CPU 202 and the RAM 226. The process control circuit 216 along with the CPU 202 refers to set values, which will be described later, stored in the storage unit 204, and controls an image forming section 230, including the exposure device 68, the image forming unit 110, the developer container unit 44 and the like, via the image forming section I/F circuit 218. The sheet conveying section control circuit 220 along with the CPU 202 controls a sheet conveying section 232, including the feeding roller 26, the retard roller 28, the resist roller 38 and the like.

Meanwhile, since the CPU 202 can compare the data stored in the storage unit 204 with the data stored in the unit NVM 184, and then determine the state of the toner cartridge 52 having the memory chip 170 thereto, the memory chip 170 constitutes a part of detecting unit, even if it does not have any sensor.

Next, data that is stored in the program ROM 224, the main body NVM 228 and the unit NVM 184 will now be described in detail.

Figure 13:
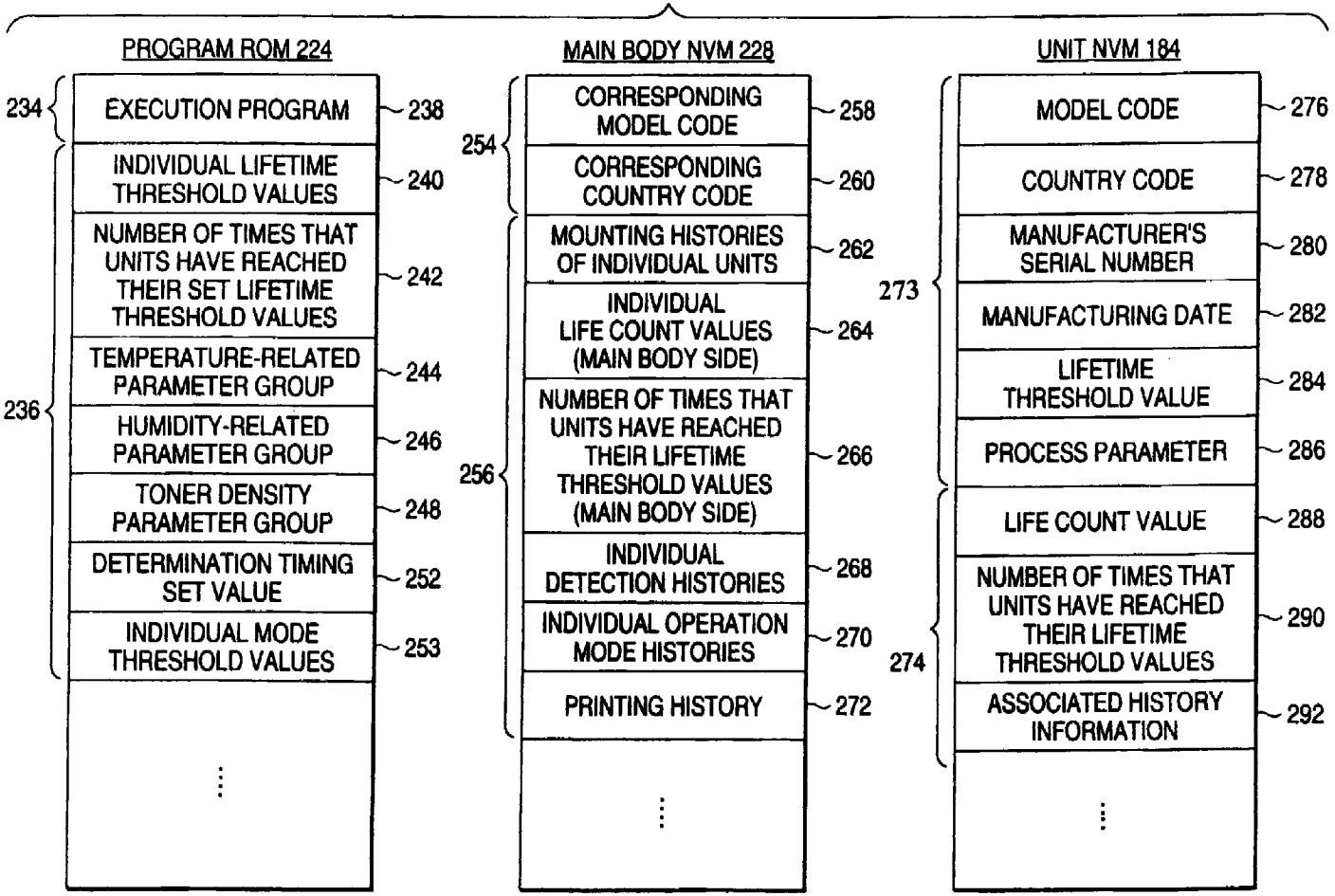
FIG. 13 is a memory map exemplarily showing data which are stored in a program ROM, a main body NVM, and a unit NVM.

FIG. 13 illustrates an example of the data stored in the program ROM 224, the main body NVM 228 and the unit NVM 184.

The program ROM 224 is provided with a program region 234, a set value region 236, and the like. The program region 234 stores an execution program 238 for operating the image forming apparatus 10. The set value region 236 stores individual lifetime threshold values 240, number of times that units reached their set lifetime threshold values 242, a temperature-related parameter group 244, a humidity-related parameter group 246, a toner density parameter group 248, determination timing set values 252, and individual mode threshold values 253.

The individual lifetime threshold values 240 include lifetimes (lifetime threshold values) of the respective replaceable units of the image forming apparatus 10. For example, the individual lifetime threshold values are previously set for genuine articles and for those that are not genuine.

The number of times that units have reached their set lifetime threshold values 242 include the number of times which allows the respective replaceable units of the image forming apparatus 10 to arrive at the lifetime threshold value. The temperature-related parameter group 244 includes individual parameters related to the control of the temperature of the image forming apparatus 10. The humidity-related parameter group 246 includes individual parameters related to the control of the humidity of the image forming apparatus 10. The toner density parameter group 248 includes individual parameters related to the control of the toner density in the developer container 48. The determination timing set values 252 include a period of time (determination timing) which is taken until the CPU 202 starts to determine whether or not the respective replaceable units of the image forming apparatus 10 are the genuine articles, in a process (FIG. 18) or the like in which the image forming apparatus 10 performs printing preparation fit to an operation mode.

The individual mode threshold values 253 include a reference application quantity which is previously set for each of other operation modes (that is, operation modes corresponding to the non-genuine articles) in the image forming apparatus 10. The reference application quantity is an upper limit of a period of application time (the number of printing sheets, the life count value or the like) within which the operation can be assured, for example, when an operation mode corresponding to the non-genuine article is applied. The image forming apparatus 10 calculates the cumulative consumptions (the number of printing sheets, the life count value or the like) of other operation modes based on the individual operation mode histories 270 (described below) and compares the calculated cumulative consumptions and the individual mode threshold values 253 to determine whether or not a purport that the application quantity in the operation mode exceeds the reference application quantity should be notified.

The main body NVM 228 is provided with a corresponding unit information region 254 and a main-body-side update region 256, and the like.

The corresponding unit information region 254 stores corresponding model codes 258 and corresponding country codes 260. The corresponding model codes 258 store a table (data) of models showing whether each of the individual replaceable units of the image forming apparatus 10 is a model which matches with the image forming apparatus 10. The corresponding country codes 260 store a table (data) of individual countries which sets specifications different in each country for the individual replaceable units of the image forming apparatus 10.

The main-body-side update region 256 stores mounting histories 262 of individual units, individual life count values 264 on the main body side, number of times that units have reached their lifetime threshold values 266 on the main body side, individual detection histories 268, individual operation mode histories 270, and the like. The individual unit mounting histories 262 include mounting histories of individual replaceable units of the image forming apparatus 10. Further, a value showing that a genuine article is mounted is stored in an initial state (as an initial value) of each of the individual unit mounting histories 262. The individual life count values 264 on the main body side include individual life count values (consumption up to the present time from the time when replaceable units begin to be used) of individual replaceable units of the image forming apparatus 10. Meanwhile, the consumption of the individual units may be calculated from the cumulative operation time or the like of each of the individual units. The number of times that units have reached their lifetime threshold values 266 on the main body side includes number of times that individual replaceable units of the image forming apparatus 10 have reached their lifetime threshold values. The individual detection histories 268 include histories of detection results detected by respective sensors or the like provided in the image forming apparatus 10. The individual operation mode histories 270 include histories of operation modes applied to individual replaceable units of the image forming apparatus 10. Moreover, the image forming apparatus 10 stores an operation mode (a default mode S) corresponding to the genuine article as an initial value of each operation mode history 270. Further, when an operation mode is selected by the user, the image forming apparatus 10 adds the selected operation mode history. In addition, when the same operation mode as the latest operation mode is selected by the user, the image forming apparatus 10 overwrites the operation mode to the latest operation mode. That is, when the same operation mode is consecutively selected, it is collectively stored as a single operation mode. Further, the printing history 272 includes the history of the printing process by the image forming apparatus 10.

The unit NVM 184 is provided with a unit information region 273, a unit-side update region 274, and the like.

The unit information region 272 stores model codes 276 indicating a model, country codes 278 indicating a country in which the specification of a model is set, manufacturer's serial numbers 280 and manufacturing dates 282, which are unique to the individual units, lifetime threshold values 284 indicating lifetime of the unit, process parameters 286 for process control, and the like.

The unit-side update region 274 stores life count values 288 showing the consumption of the toner cartridge 52 up to the present time from the time when the toner cartridges being to be used, number of times that units have reached their lifetime threshold values 290 showing the number of times which arrives at a lifetime threshold value stored in the lifetime threshold values 284, associated history information 292, and the like. Meanwhile, the associated history information 292 includes histories of associated information, such as the number of revolutions of the image carrier 54, available for grasping the state of the toner cartridge 52.

In FIG. 14, the history information which is managed by the image forming apparatus 10 is exemplified.

As exemplarily shown in FIG. 14(A), the mounting history 262 (FIG. 13) includes the replacement timing of each unit, the attribute information of the mounted unit, and the consumption of the mounted unit as a table in which the replacement timing, the attribute information, and the consumption are associated with each other. The replacement timing of the unit includes the information which indicates that each unit is mounted or removed, and the date and time of the mounting or removal. That is, the image forming apparatus 10 stores the replacement history of the unit.

Further, the attribute information of the unit includes the manufacturer's serial number of each unit, the country code (area information) indicating an area in which each unit is to be used, and the discrimination result of discriminating whether or not each unit is the genuine article. The manufacturer's serial number of each unit is the information for identifying each unit. And then, by storing the manufacturer's serial number of the mounted unit in association with the operation mode and the like, the image forming apparatus 10 can manage the history information or the like for every unit. Moreover, in the attribute information of the unit, the model code of the unit may be included.

Further, the consumption of each unit includes the number of printing sheets when each unit is used for the printing, the life count value which indicates the cumulative driving time of each unit, or the like. The image forming apparatus 10 of the present example stores the cumulative consumption of each unit up to now and the consumption used in each printing process as the consumption of each unit.

As exemplarily shown in FIG. 14(B), the operation mode history 270 includes an operation mode switching timing, an operation mode after switching (that is, applied operation mode), and detailed information of each operation mode. The operation mode switching timing, the operation mode after switching, and the detailed information of each operation mode are associated with each other.

The operation mode switching timing is the information indicating the timing at which the operation mode changes. Meanwhile, when the user selects the same operation mode as the latest operation mode again, the operation mode does not change. In this case, the image forming apparatus 10 does not store the selected operation mode as the operation mode history. That is, only if the operation mode changes, the image forming apparatus 10 stores the switching date and time of the operation mode (switching timing), the applied operation mode, and the detailed information of the operation mode as the operation mode history 270. Further, the image forming apparatus 10 can generate a period of time, in which each operation mode is being applied, as the history information, based on the operation mode switching date and time and the applied operation mode which are included in the operation mode history 270.

The detailed information of the operation mode includes, for example, the information (correction parameters, image density parameters, toner density parameters, or the like) which indicates the image forming conditions when each operation mode is set. The image forming apparatus 10 of the present example stores the detailed information of the operation mode as the operation mode history 270 only when the operation mode corresponding to the non-genuine article is set. This is because the well-known image forming conditions are being applied when the operation mode corresponding to the genuine article is set. Further, the image forming apparatus 10 may store the temperature and the humidity within the apparatus when the operation mode corresponding to the non-genuine article is set, as the detailed information of the operation mode. This is because the genuine toner and the non-genuine toner may have different characteristics from each other to the temperature or humidity.

As exemplarily shown in FIG. 14(C), the printing history 272 includes the timing of the printing process (printing date and time) which is performed according to the user's request, error codes which indicate abnormality generated during the printing process, and the number of printing sheets printed by the printing process.

The printing date and time indicates, for example, the date and time on which the request (printing job) of the printing process from the user is made.

The error codes include error information which indicates abnormal states in which the image formation process is consecutively performed, as well as abnormal states which follow the compulsive stop of the image formation process. Further, the error codes may be output directly on the UI device 18 or they may be output on the UI device 18 or the like for the first time when the administrator who performs maintenance management of the image forming apparatus 10 performs constant operations.

The number of printing sheets indicates the number of printing sheets printed by once printing process. Moreover, the number of printing sheets may be the cumulative number of sheets. When each operation mode is being applied, the image forming apparatus 10 can generate the use state (history information regarding the use of the replaceable unit) of the unit based on the printing date and time and the number of printing sheets which are included in the printing history 272, and the operation mode switching date and time and the applied operation mode which are included in the operation mode history 27Q.

The history information may be stored in the unit NVM 184, as well as the main body NVM 228. In this case, preferably, history information (operation mode, image forming condition, and consumption) when the unit was mounted to other image forming apparatus 10 may be also stored in the unit NVM 184 to be managed.

Next, a control of the image forming apparatus 10 based on data which are stored in the storage unit 204 and the unit NVM 184 will be described.

Figure 15:
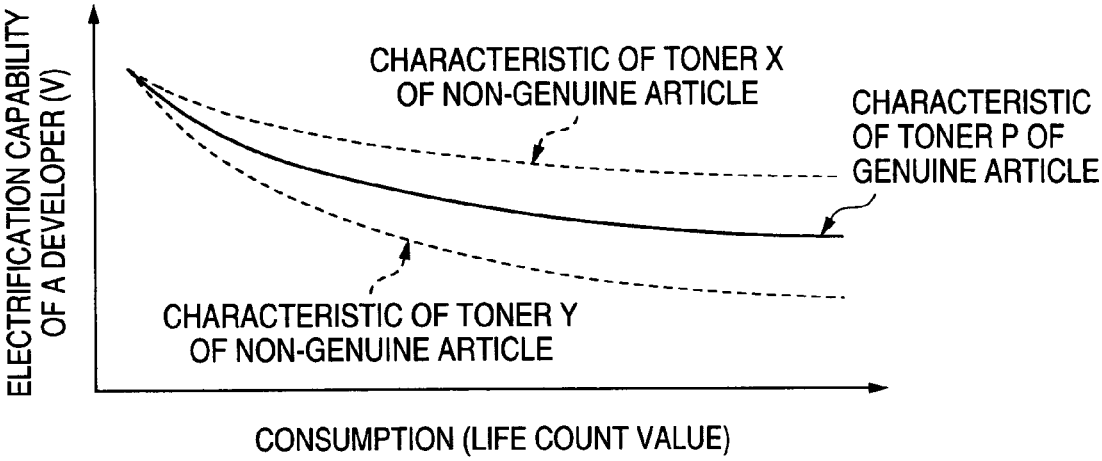
FIG. 15 is a graph showing a change in electrification capability of a developer with respect to a consumption (a life count value) stored in the main body NVM 228.

FIG. 15 is a graph showing a change in the electrification capability of a developer with respect to the consumption (life count value) of the developer stored in the main body NVM 228.

Figure 16:
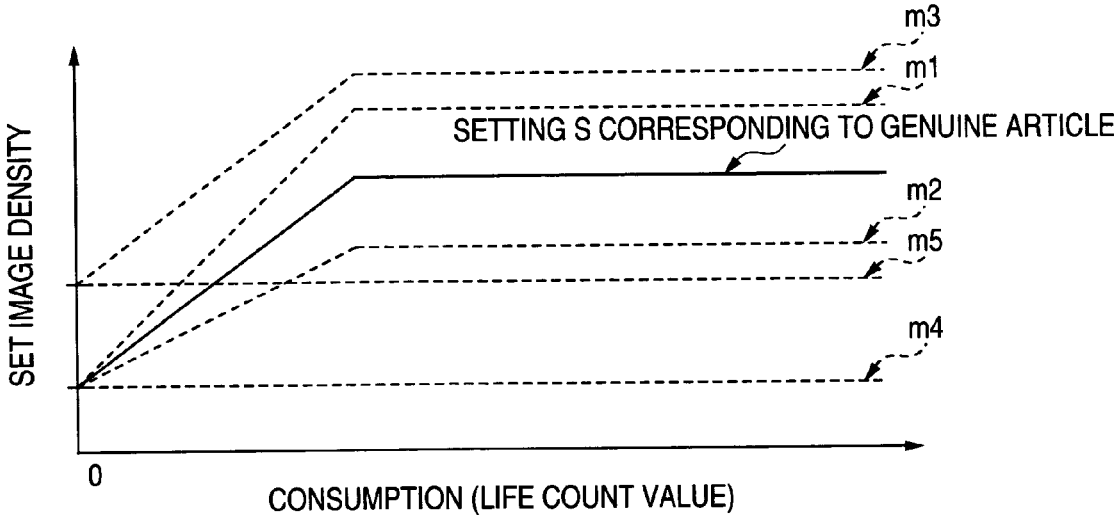
FIG. 16 is a graph showing a setting for correcting a change in electrification capability of the developer, which shows a setting of an image density with respect to the consumption of the developer.

FIG. 16 is a graph showing setting for correcting a change in the electrification capability of the developer, which shows setting of an image density with respect to the consumption of the developer.

Figure 17A:
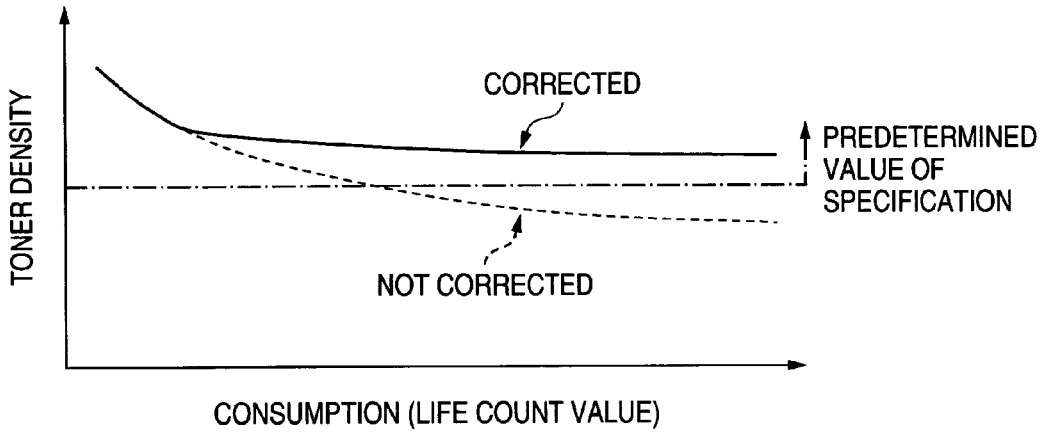
Figure 17B:
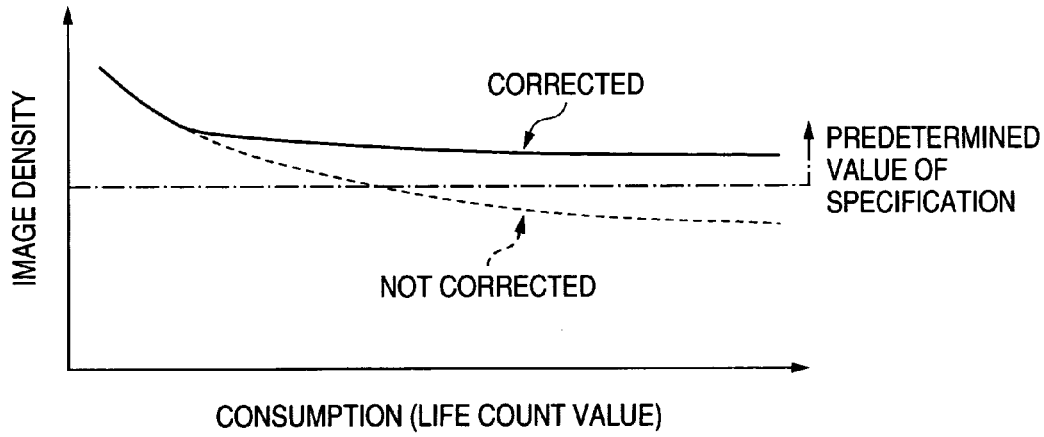

FIGS. 17A and 17B are graphs showing results corrected by the setting shown in FIG. 15, in which FIG. 16A shows a corrected toner density, and FIG. 16B shows a corrected image density.

A toner accommodated in the toner cartridge 52 is frictionally electrified so as to have predetermined polarity and electric charge quantity by a carrier in the developer container 48. When a developer is used, the electrification capability of the developer deteriorates according to the consumption of the developer, like characteristics of a genuine toner P shown in FIG. 14.

Thus, even when the image forming apparatus 10 employs a trickle development method, in order to maintain the image quality of an image formed on a sheet at a predetermined level, the setting on the density of a toner in the developer container 48 and the density of an image on the intermediate transfer body 74 should be corrected.

For example, the CPU 202 makes the image density sensor 90 detect the density of an image. At this time, if the image density is high, the CPU 202 controls the rotational drive of the first auger 118 to reduce the amount of a toner to be supplied into the developer container 48, thereby lowering the density of the toner, which lowers the density of the image. Further, if the image density is low, the CPU 202 controls the rotational drive of the first auger 118 to increase the amount of a toner to be supplied into the developer container 48, thereby raising the density of the toner, which raises the density of the image. Generally, a pattern having half-tone density is used as a pattern for detecting the above-mentioned image density.

However, when the electrification capability of a toner deteriorates, the development performance of the toner is improved and the image density is raised. Therefore, if the above-mentioned control is executed as it is, the toner density may be excessively lowered, which may lower a maximum image density.

Accordingly, even when the electrification capability of a developer deteriorates, in order for the maximum density of an image transferred onto a sheet not to be lowered, the set values for controlling the density of a toner in the developer container 48, which are stored in the toner image parameter group 248 used for controlling the toner density based on the image density detection results detected by the image density sensor 90, are corrected to increase according to the consumption of the developer. The CPU 202 makes the first auger 118 rotate according to the corrected set values (setting S corresponding to the toner P in FIG. 16) so that the toner density can be maintained so as not to be below a desired predetermined value, as shown in FIG. 17A.

As a result, as shown in FIG. 17B, the image density can be maintained so as not to be below a specified set value.

On the other hand, in case a toner cartridge other than a genuine cartridge, which contains a toner X or a toner Y other than a genuine toner P for the image forming apparatus 10 and has substantially the same construction as that of the toner cartridge 52, is mounted, as shown in FIG. 15, it is expected the toner X or the toner Y will exhibit characteristics different from those of the genuine toner P. Thus, in order to improve the quality of an image to be formed on a sheet, corrected set values different from the setting S corresponding to the toner P are required. Accordingly, for example, in the case of any cartridge other than a genuine cartridge, which contains the toner X or the toner Y, correction is made to the consumption of a developer obtained by combining conditions to be changed, such as increasing or decreasing the degree of a change (gradient) in a set value of the toner density (m1 or m2 in FIG. 16); increasing or decreasing a limit value (m1 or m2); varying an initial value (consumption=0) (m3); no making a change in a set value according to the consumption (m4); and no making a change in a set value according to the consumption, for example, by varying an initial value (m5). This change is performed by allowing a user to select an operation mode other than that corresponding to the genuine toner via the UI device 18.

Moreover, in the present example, the setting m1 is associated with 'mode A' which is an operation mode corresponding to the non-genuine article. If the mode A is set, the image forming apparatus 10 performs the image formation by applying the setting m1. Similarly, the setting m2 is associated with 'mode B' which is an operation mode corresponding to the non-genuine article, the setting m3 is associated with 'mode C' which is an operation mode corresponding to the non-genuine article, the setting m4 is associated with 'mode D' which is an operation mode corresponding to the non-genuine article, and the setting m5 is associated with 'mode E' which is an operation mode corresponding to the non-genuine article. That is, for the non-genuine articles (toner cartridges or the like), the image forming apparatus 10 has in advance a plurality of operation modes, of which correction quantities are different from each other in the image formation process. Further, the operation mode corresponding to the non-genuine article is preferably a mode (a save mode) in which a disorder (a stain in the apparatus due to the toner or the like) in the image forming apparatus 10 is difficult to be caused, as compared to 'a default mode S' set under the well-known performance of the genuine article.

Further, on the basis of the data stored in the storage unit 204 and the unit NVM 184, the image forming apparatus 10 controls display or the like by the UI device 18. For example, if the toner cartridge 52 is the genuine article, the residual quantity of the toner is displayed on the UI device 18, whereas if the toner cartridge 52 is the non-genuine article, the consumption of the toner is displayed on the UI device 18. This is because, if the toner cartridge 52 is the non-genuine article, the quantity of the toner is unknown, so the residual quantity of the toner can not be calculated.

Next, the image formation process by the image forming apparatus 10 having the above-mentioned configuration will be described.

Figure 18:
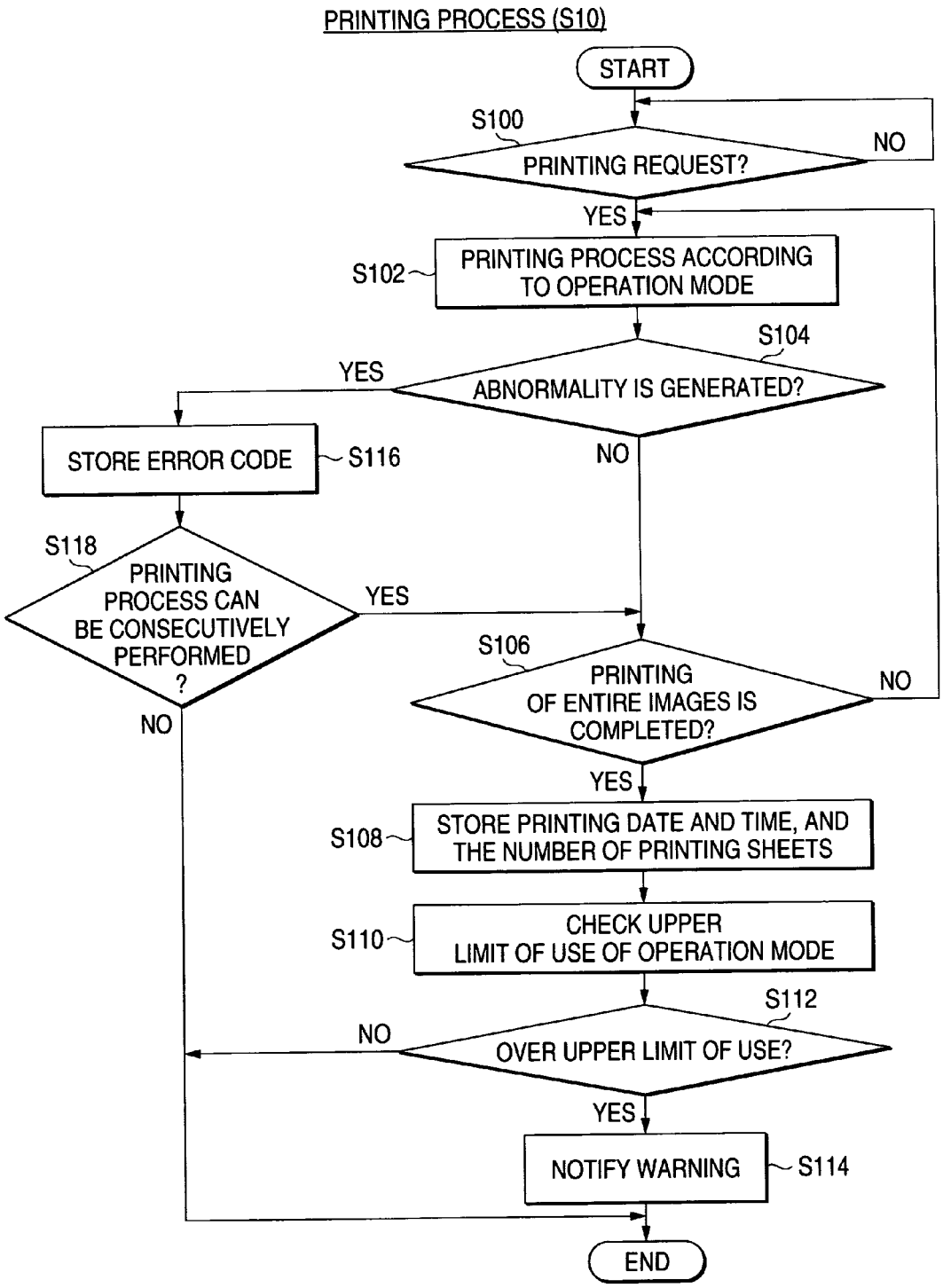
FIG. 18 is a flowchart (S10) showing a printing process by the image forming apparatus 10.

FIG. 18 is a flowchart of the printing process (S10) by the image forming apparatus 10.

As shown in FIG. 18, in the step 100 (S100), if the image forming apparatus 10 receives image forming signals from the host apparatus 2 (FIG. 1), for example, the process progresses to the step S102, and then the image formation process starts.

In the step 102 (S102), when image forming signals are transmitted to the image forming apparatus 10, the image forming apparatus 10 performs the printing process by operating the individual elements according to the set operation mode. More specifically, the image carrier 54 is uniformly electrified by the electrifying device 60, and light rays are emitted onto the electrified image carrier 54 from the exposure device 68 on the basis of the image signals. The light rays from the exposure device 68 expose the surface of the image carrier 54, thereby forming a latent image.

The latent image carried by the image carrier 54 is developed at a development position by the developer container unit 44. In the developer container unit 44, the developer containers 48*a* to 48*d* are respectively supplied with yellow, magenta, cyan and black toners from the toner cartridges 52*a* to 52*d*. Further, toners excessively supplied to the developer containers 48*a* to 48*d* are respectively collected into the toner cartridges 52*a* to 52*d*. Toner images developed for the respective colors by the developer containers 48*a* to 48*d* of the developer container unit 44 are superposed on the intermediate transfer body 74 to be primarily transferred thereto. At the time of the primary transfer, a waste toner remaining on the image carrier 54 is scraped by the cleaner 62 for the image carrier 54 to be collected.

On the other hand, upon receiving sheet feeding signals or the like, sheets received in the sheet feeding cassette 24 are fed by the feeding roller 26, are separated by the retard roller 28, and are respectively guided to the conveying path 34. And then the sheet is primarily stopped by the resist roller 38 and is guided between the secondary transfer roller 88 and the secondary transfer backup roller 82 at a predetermined timing. When a sheet is guided between the secondary transfer roller 88 and the secondary transfer backup roller 82, a toner image in which four colors overlap each other by the primary transfer onto the intermediate transfer body 74 is secondarily transferred on the sheet by the secondary transfer roller 88 and the secondary transfer backup roller 82. After the secondary transfer, the waste toner remaining on the intermediate transfer body 74 is scraped by the cleaner 92 for the intermediate transfer body 74 to be collected.

The sheet onto which the toner image has been transferred is guided to the fixing device 100, and the toner image on the sheet is fixed by a thermal pressure generated by the heating roller 102 and the pressing roller 104. The sheet on which the toner image has been fixed is discharged from the discharge port 36 toward the discharge section 42 by means of the discharge roller 40.

In the step 104 (S104), when abnormality is generated during the printing operation, the image forming apparatus 10 performs S116. In other cases, the process progresses to S104.

In the step 106 (S106), the image forming apparatus 10 determines whether or not requested entire printing processes are completed. If the requested entire printing processes are completed, the process progresses to S108. If not so, however, the process progresses to S102 to print the next image.

In the step 108 (S108), the control unit 106 stores the printing date and time and the number of printing sheets as the printing history 272 (FIGS. 13 and 14) in the main body NVM 228.

Further, the control unit 106 stores the life count value or the like of the toner cartridge 52 in the unit NVM 184 and the main body NVM 228.

In the step 110 (S110), the control unit 106 calculates a sum of the number of printing sheets printed in the currently set operation mode based on the operation mode switching date and time and the applied operation mode which are included in the operation mode history 270 and the printing date and time and the number of printing sheets which are included in the printing history 272, and compares the calculated sum of the number of printing sheets to the reference application quantity (an upper limit of the number of printing sheets in the operation mode) which is included in the individual mode threshold values 253.

In the step 112 (S112), when the set operation mode is an operation mode which corresponds to the non-genuine article and the sum of the number of printing sheets printed in the operation mode exceeds the reference application quantity, the control unit 106 performs S114. In other cases, the printing process (S10) ends.

In the step 114 (S114), the control unit 106 transmits to the host apparatus 2 a message purporting that the application quantity in the operation mode exceeds the reference application quantity. The host apparatus 2 displays the received message from the image forming apparatus 10 (the control unit 106) to notify the user that the consumption in the currently applied operation mode exceeds the reference application quantity.

In the step S116 (S116), when detecting the abnormal state, the control unit 106 stores the error code indicating the detected abnormal state as the printing history 272 in the main body NVM 228.

In the step 118 (S118), based on the abnormal state, the control unit 106 determines whether or not the printing process can be consecutively performed. If it is determined that the printing process can be consecutively performed, the process progresses to S106, and then the printing process is continued. If it is determined that the printing process can not be consecutively performed, the printing process is compulsively stopped.

As such, during the printing process, the image forming apparatus 10 stores the printing history 272 or the like in association with the replacement history of the unit and the operation mode switching history. Further, when the operation mode corresponding to the non-genuine toner cartridge is set, the image forming apparatus 10 warns the user based on the set reference application quantity to the operation mode. Thus, the user can be well aware of a relationship between a failure during the printing process and the set operation mode based on the history information. Further, in a situation in which the operation can not be assured, the user can be notified that the printing process exceeding the reference is being made.

Moreover, in the above-mentioned flowchart (S10), the image forming apparatus 10 compares the application quantity of the operation mode to the reference application quantity (S110) and notifies the user of the message (S114). However, the present invention is not limited to the process shown in the flowchart. For example, the image forming apparatus 10 may compare the cumulative consumption (cumulative driving time or the number of printing sheets) of each unit to the reference consumption and notify the user of the message purporting that the cumulative consumption of each unit exceeds the reference consumption.

Next, a method of controlling the image forming apparatus 10 based on data stored in the storage unit 204 and the unit NVM 184 will be described.

Figure 19:
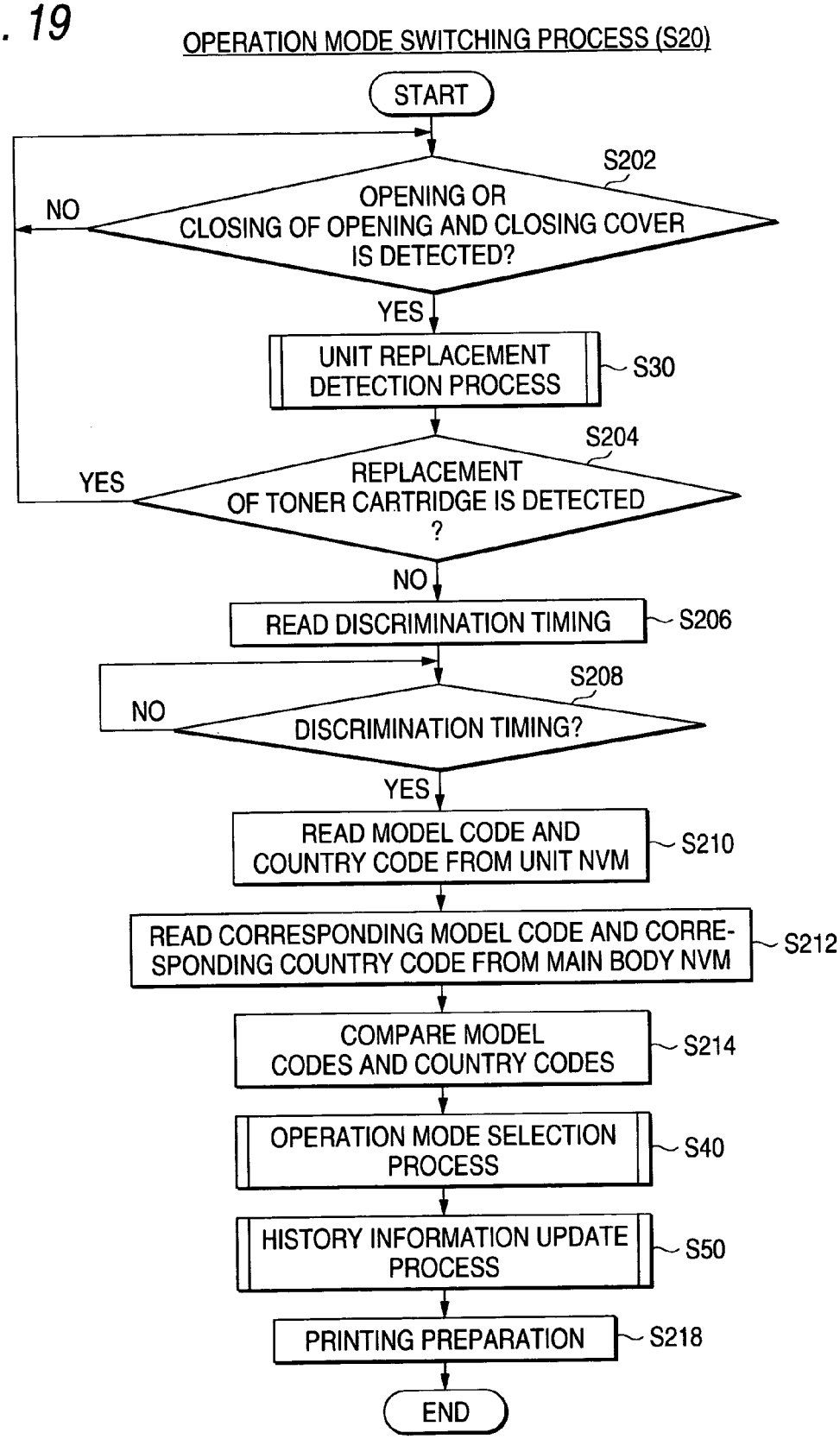
FIG. 19 is a flowchart (S20) showing an operation mode switching process which is performed in the image forming apparatus 10.

FIG. 19 is a flowchart (S20) showing an operation mode switching process which is performed in the image forming apparatus 10.

Figure 20:
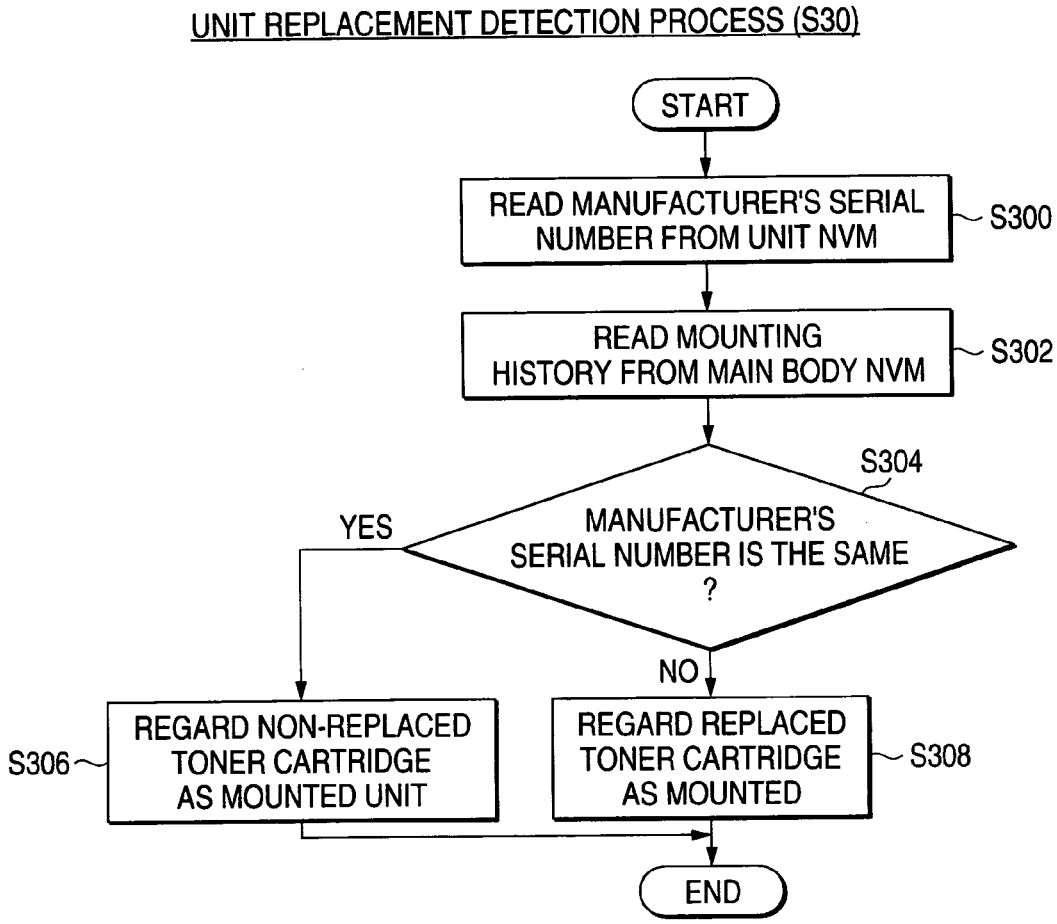
FIG. 20 is a flowchart (S30) showing a unit replacement detection process of detecting whether or not the toner cartridge 52 has been replaced.

FIG. 20 is a flowchart (S30) showing a unit replacement detection process of detecting whether or not the toner cartridge 52 has been replaced.

Figure 21:
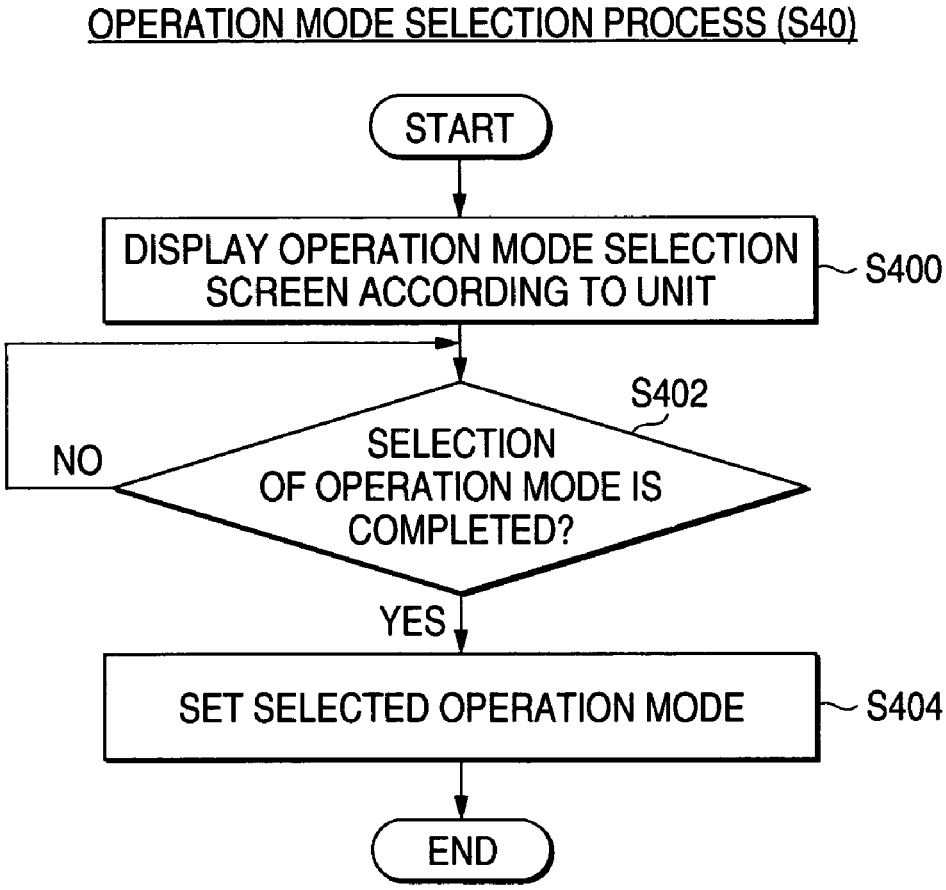
FIG. 21 is a flowchart (S40) showing an operation mode selection process to be performed by the image forming apparatus 10 such that a user can select an operation mode.

FIG. 21 is a flowchart (S40) showing an operation mode selection process to be performed by the image forming apparatus 10 such that a user can select an operation mode.

As shown in FIG. 19, in the step 202 (S202), the CPU 202 determines whether or not an opening and closing detecting sensor 19 detects opening or closing of the opening and closing cover 16. If the CPU 202 determines that opening or closing of the opening and closing cover 16 is detected, the process progresses to S30. In other cases, the process returns to S202. That is, when the opening and closing cover 16 is opened or closed, there is a possibility of the toner cartridge 52 to have been replaced, and thus the unit replacement detection process is performed.

In the step 300 (S300 in FIG. 20), the CPU 202 reads the manufacturer's serial number 280 from the unit NVM 184.

In the step 302 (S302), the CPU 202 reads the manufacturer's serial number of the last mounted toner cartridge, which is included in the mounting history 262 of each unit of the main body NVM 228.

In the step 304 (S304), the CPU 202 determines whether or not the manufacturer's serial number of the last mounted toner cartridge is equal to the manufacturer's serial number 280 read from the unit NVM 184. If the manufacturer's serial number of the last mounted toner cartridge is equal to the manufacturer's serial number 280 read from the unit NVM 184, the process progresses to S306. In other cases, the process progresses to S308.

In the step 306 (S306), the CPU 202 regards a not-replaced toner cartridge 52 as mounted again (not replaced).

In the step 308 (S308), the CPU 202 regards a replaced toner cartridge 52 as mounted (replacement is detected).

In the step 204 (S204 in FIG. 19), if the CPU 202 determines that the replacement of the toner cartridge 52 is detected, the process progresses to S206. In other cases, the process returns to S202.

In the step 206 (S206), the CPU 202 reads the determination timing set value 252 from the program ROM 224.

Moreover, the determination timing set value 252 may be zero (0).

In the step 208 (S208), the CPU 202 determines by a timer (not shown) whether or not it is the determination timing to start the determination that the mounted toner cartridge 52 is the genuine article or the non-genuine article. If it is the determination timing to start the determination of the genuine article or the non-genuine article, the process progresses to S210. In other cases, the CPU 202 waits until the determination timing comes.

In the step 210 (S210), the CPU 202 reads the model code 276 and the country code 278 from the unit NVM 184.

In the step 212 (S212), the CPU 202 reads the corresponding model code 258 and the corresponding country code 260 from the main body NVM 228.

In the step S214 (S214), the CPU 202 compares the model code 276 and the country code 278 to the corresponding model code 258 and the corresponding country code 260 and determines whether or not the replaced toner cartridge 52 is the genuine article.

The CPU 202 updates the mounting history (the unit replacement date and time, the attribute information, and the consumption) of the toner cartridge 52 which is included in the mounting history 262 of each unit of the main body NVM 228 according to data read from the currently mounted toner cartridge 52, and then the process progresses to S40.

Figure 22A:
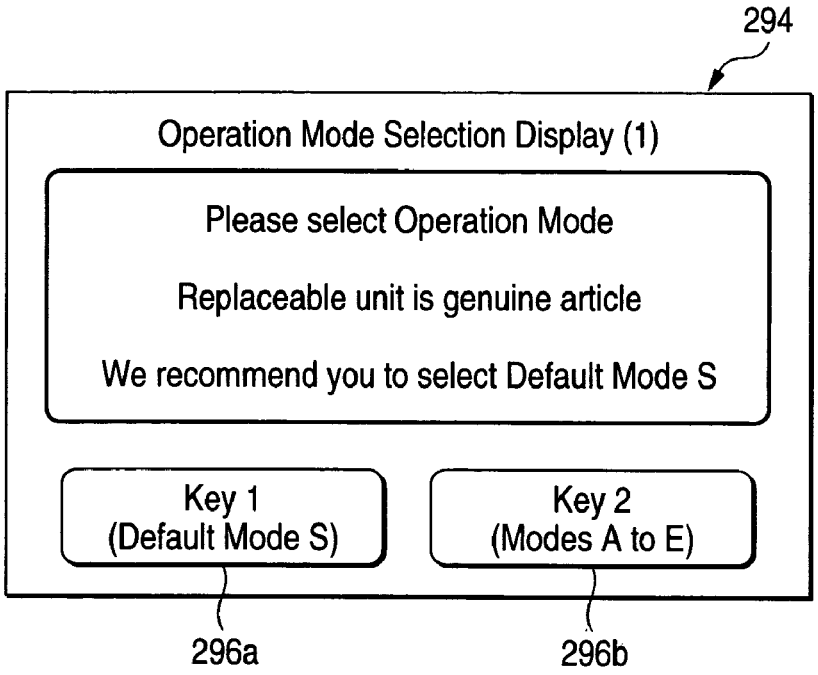
Figure 22B:
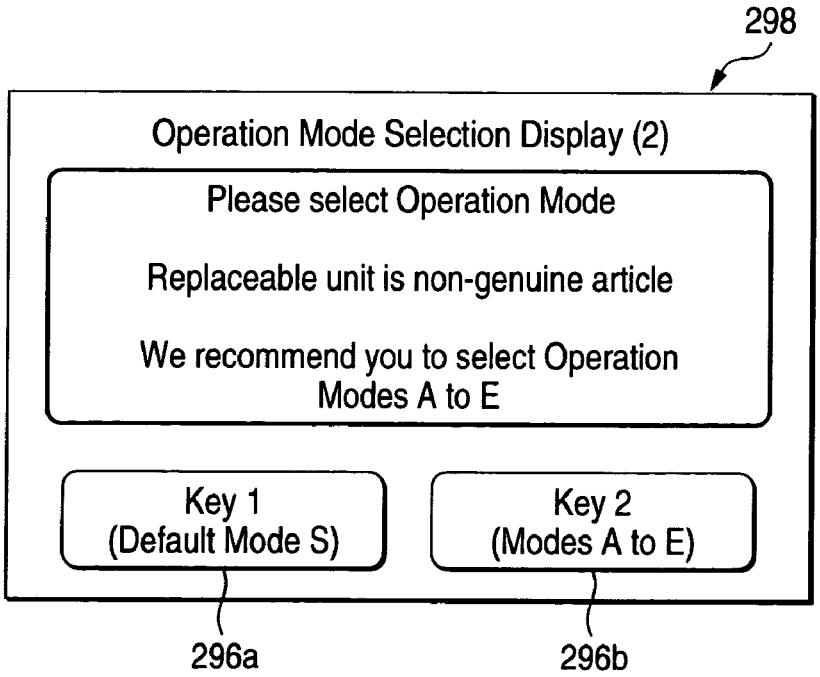

In the step 400 (S400), as exemplarily shown in FIG. 22, the UI device 18 displays the operation mode selection screen according to the mounted toner cartridge 52 (the genuine article or the non-genuine article). Specifically, when the mounted toner cartridge 52 is the genuine article, the UI device 18 displays an operation mode selection screen 294 shown in FIG. 22(A). Further, when the mounted toner cartridge 52 is the non-genuine article, the UI device 18 displays an operation mode selection screen 298 shown in FIG. 22(B). On the operation mode selection screen 294 corresponding to the genuine article, a key button 296*a* for selecting a default mode S (an operation mode corresponding to the genuine article), a key button 296*b* for selecting other operation modes (operation modes corresponding to the non-genuine articles), and messages purporting that the mounted toner cartridge is the genuine article and that it is preferable to select the default mode S are displayed. On the operation mode selection screen 298 corresponding to the non-genuine article, a key button 296*a* and a key button 296*b* similar to those described above, and messages purporting that the mounted toner cartridge is the non-genuine article and that it is preferable to select other operation modes (the mode A to the mode E) are displayed. Moreover, the mode A to the mode E can be selected by consecutively pressing the key button 296*b*.

In the step 402 (S402), the CPU 202 determines whether or not an input which selects the key button 296*a* or the key button 296*b* displayed on the operation mode selection screen 294 (or the operation mode selection screen 298) is finished. If the input which selects any one of the key button 296*a* and the key button 296*b* is finished, the process progresses to S404. If the input which specifies any one of the operation modes is not finished, the image forming apparatus 10 waits until the user selects an operation mode.

In the step 404 (S404), the CPU 202 updates (or overwrites) each operation mode history 270 of the main body NVM 228 to the operation mode selected in S402.

In the step 50 (S50), the CPU 202 updates each operation mode history 270 of the main body NVM 228 according presence/absence of the printing process.

In the step 218 (S218 in FIG. 19), the CPU 202 performs the printing preparation fit to the selected operation mode which is included in each newest operation mode history 270, and then the process ends. Moreover, in the printing preparation in S218, for example, whether or not the mounted toner cartridge 52 is the genuine article may be displayed on the UI device 18.

Moreover, in the above-mentioned flowchart (S20), the operation mode switching following the replacement of the toner cartridge (unit) has been described, but the operation mode switching can be performed at an arbitrary timing by the selection of the user. In this case, the CPU 202 displays the operation mode selection screen (FIG. 22) on the UI device 18 according to the instruction of the user, detects the selection operation of the key button 296*a* or the key button 296*b*, and switches the operation mode by storing the selected operation mode in each operation mode history 270 of the main body NVM 228.

Figure 23:
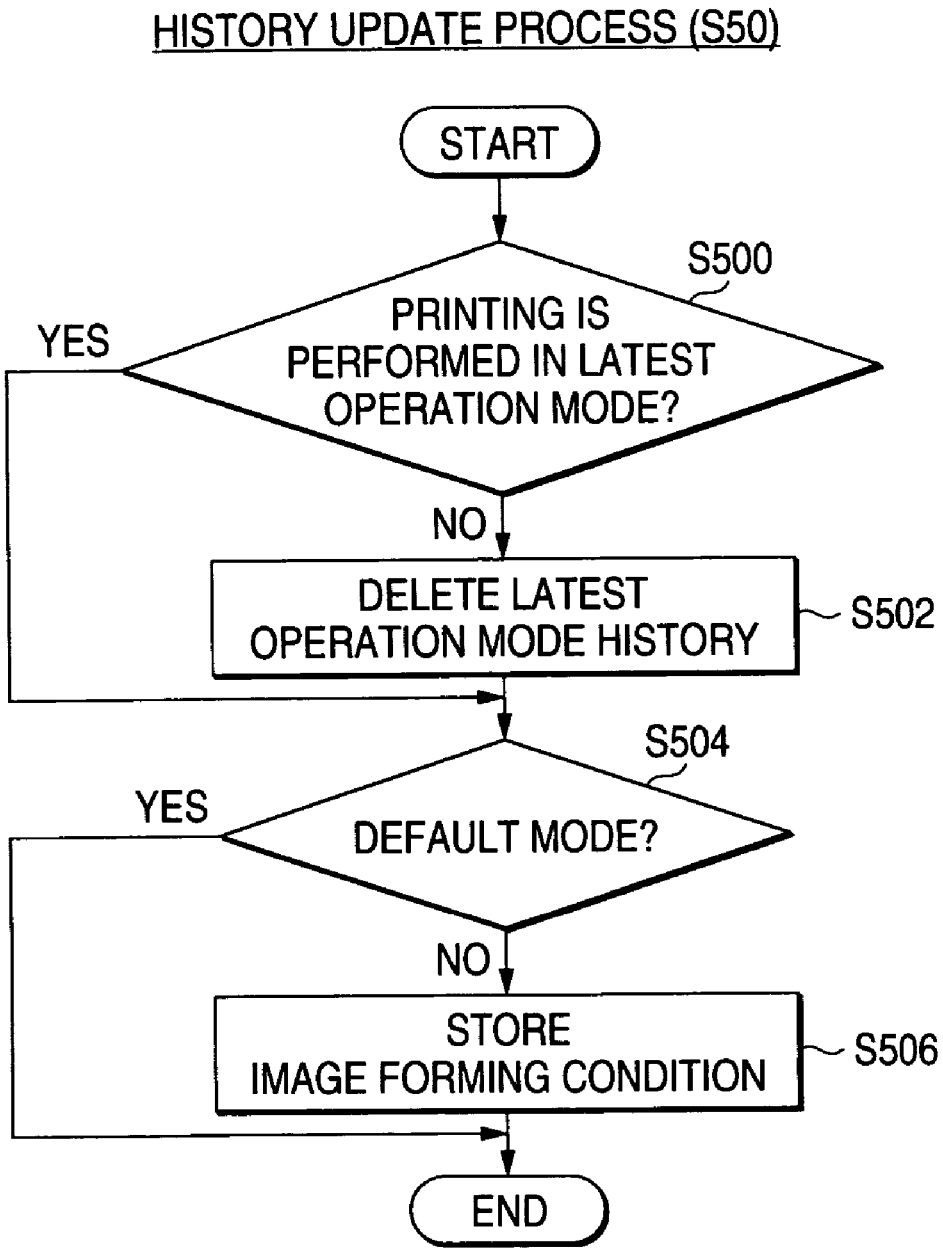
FIG. 23 is a flowchart illustrating a history update process (S50) shown in FIG. 19 in detail.

FIG. 23 is a flowchart illustrating the history update process (S50) shown in FIG. 19 in detail.

As shown in FIG. 23, in the step 500 (S500), the CPU 202 specifies a period of time, in which the latest operation mode was set, based on each operation mode history 270 of the main body NVM 228 and, based on the specified period of time and the printing history 272, determines whether or not the printing process was made in the latest operation mode. If the printing process was made in the latest operation mode, the CPU 202 performs S504. If the printing process was not made in the latest operation mode, the process progresses to S502.

In the step 502 (S502), the CPU 202 deletes the history information (the operation mode switching date and time, the applied operation mode, and the detailed information of the operation mode) regarding the latest operation mode from each operation mode history 270 of the main body NVM 228. That is, the image forming apparatus 10 does not store the history information regarding an operation mode in which the printing process was not actually made, even if the operation mode is selected by the user. This is because the selection operation of the operation mode (in which the printing operation was not actually made) is regarded as made due to the disoperation of the user.

In the step 504 (S504), the CPU 202 determines the currently set operation mode with reference to each operation mode history 270 of the main body NVM 228. If the operation mode (the default mode S) corresponding to the genuine article is set, the history update process (S50) ends. If the operation mode (the modes A to E) corresponding to the non-genuine article is set, the process progresses to S506.

In the step 506 (S506), the CPU 202 stores the set image forming conditions (the correction parameters or the like) as the operation mode detailed information (FIG. 14(B)) with the applied operation mode associated with each operation mode history 270 of the main body NVM 228. That is, the image forming apparatus 10 stores the detailed information of the operation mode as the operation mode history 270 only if the operation mode corresponding to the non-genuine article is set.

FIG. 24 is a diagram exemplarily showing a history display screen 299 displayed on the UI device 18.

As exemplarily shown in FIG. 24, the image forming apparatus 10 creates a history report based on the mounting history 262, the operation mode history 270, and the printing history, which are stored in the main body NVM 228, according to the user's request, and displays the created history report on the history display screen 299. In the history display screen 299 of the present example, the name of the operation mode, which is applied after each unit (toner cartridge) is replaced, the cumulative number of printing sheets up to the operation mode switching time, and the switching date and time of the operation mode are included.

Moreover, the history display screen 299 may be displayed on the host apparatus 2 based on history report data transmitted from the image forming apparatus 10.

As such, in the image forming apparatus 10 of the present invention, even when the replaceable unit is the non-genuine article, the user may select other operation modes different from the operation mode corresponding to the genuine article, and thus the image quality can be improved.

Further, if all of the replaceable units are the genuine articles, an operation mode which can be selected by the user may be limited such that the image forming apparatus 10 operates only in the operation mode corresponding to the genuine article, thereby preventing the image quality from deteriorating due to the user's misjudgment.

Further, as described above, the image forming apparatus 10 can use the non-genuine articles and can switch the operation modes by the selection of the user. Thus, by managing the operation mode switching history, the unit replacement history, the printing history, or the like to be associated with each other, a cause of a disorder (for example, a mismatch of the unit and the operation mode) can be easily specified. In particular, when the non-genuine unit is used (when the operation mode corresponding to the non-genuine article is set), the image forming apparatus 10 stores the image forming conditions (the correction parameters or the like) as the history information. Thus, for example, even when image quality deteriorations are caused, the cause can be examined and the adjustment of the image forming conditions can be easily performed for the improvement of the image quality.

Further, when the printing process is made in the operation mode corresponding to the non-genuine article over definite period of time, the image forming apparatus 10 can notify the user of the purport to urge the user's attention.

Moreover, in the above-mentioned embodiment, the image forming apparatus 10 stores the history information of the operation mode or the like when the genuine toner cartridge is mounted, as well as when the non-genuine toner cartridge is mounted. However, the present invention is not limited to the above-mentioned embodiment. For example, only when the non-genuine toner cartridge is mounted, the history information (the attribute information, the printing history, the operation mode history, and so on which are included in the mounting history) may be stored. This is because, when the non-genuine toner cartridge is mounted, there is much possibility that intolerable image quality deteriorations or the disorders of the apparatus are caused.

What is claimed is:

1. An image forming apparatus comprising:

an image forming apparatus main body;

at least one replaceable unit replaceably mounted to the image forming apparatus main body;

an input unit for selecting any one of an operation mode corresponding to the replaceable unit which is a genuine article and operation modes different from the operation mode;

a control unit for performing controls according to an operation mode selected by the input unit; and a storage unit for storing history information regarding the operation modes.

2. The image forming apparatus according to claim 1, further comprising:

a discriminating unit for discriminating whether or not the replaceable unit is the genuine article, wherein the storage unit stores the history information regarding the operation modes in association with the discrimination results by the discriminating unit.

3. The image forming apparatus according to claim 1, wherein the storage unit stores the history information regarding the operation modes on the assumption that an image formation process is performed according to the operation mode selected by the input unit.

4. The image forming apparatus according to claim 1, wherein, when an operation mode is switched by the control unit, the storage unit stores history information regarding the switching of the operation mode as the history information regarding the operation mode.

5. The image forming apparatus according to claim 4, wherein the storage unit stores information regarding an image formation process performed for each operation mode in association with the history information regarding the switching of the operation mode.

6. The image forming apparatus according to claim 1, wherein, when an operation mode identical to the operation mode which is currently applied is selected by the input unit, the storage unit is prohibited from storing history information regarding the selected operation mode.

7. The image forming apparatus according to claim 1, wherein the storage unit stores setting information, which defines an image formation process when being controlled according to other operation modes, in association with the history information regarding the operation mode.

8. The image forming apparatus according to claim 1, wherein the storage unit stores attribute information of the replaceable unit, which is sequentially replaced, in association with the history information.

9. The image forming apparatus according to claim 8, wherein the attribute information includes unit identification information for identifying each replaceable unit, and the storage unit stores unit identification information of the replaceable unit in association with the history information regarding the use of each replaceable unit.

10. The image forming apparatus according to claim 8, wherein the storage unit stores the attribute information of the replaceable unit and the history information regarding the use of the replaceable unit only for the replaceable unit which is discriminated as the non-genuine by a discriminating unit.

11. The image forming apparatus according to claim 1, further comprising:

an abnormality detecting unit for detecting abnormality in an image formation process, wherein the storage unit stores information regarding the abnormality detected by the abnormality detecting unit in association with the history information.

12. The image forming apparatus according to claim 1, further comprising:

an application quantity determining unit for determining whether or not an application quantity of each of other operation modes exceeds an established reference application quantity, based on the history information stored in the storage unit; and an output unit for outputting a purport that the application quantity of each of other operation modes exceeds a reference, when the application quantity determining unit determines that the application quantity exceeds the reference application quantity.

13. The image forming apparatus according to claim 1, further comprising:

a consumption determining unit for determining whether or not a consumption of each replaceable unit exceeds an established reference consumption, based on the history information stored in the storage unit; and an output unit for outputting a purport that the consumption of the replaceable unit exceeds a reference, when the consumption determining unit determines that the consumption exceeds the reference consumption for any one of the replaceable units.

14. An image forming apparatus comprising:

an image forming apparatus main body;

at least one replaceable unit replaceably mounted to the image forming apparatus main body;

a storage unit, provided in the replaceable unit, for storing attribute information of the replaceable unit; and a discriminating unit for discriminating whether or not the replaceable unit is a genuine article, according to the attribute information read from the storage unit, wherein the storage unit stores history information regarding a use of the replaceable unit, when it is determined by the discriminating unit that the mounted replaceable unit is a non-genuine article.

15. The image forming apparatus according to claim 14, wherein the attribute information includes area information indicating an area in which the replaceable unit is to be used, the discriminating unit compares previously stored area information to the area information read from the storage unit and discriminates whether or not the mounted replaceable unit is the genuine article, and if the discriminating unit discriminates that the replaceable unit is the non-genuine article, the storage unit stores the area information of the mounted replaceable unit in association with the history information regarding the use of the replaceable unit.

16. The image forming apparatus according to claim 14, wherein the storage unit stores attribute information of the replaceable unit, which is sequentially replaced, in association with the history information.

17. The imaging forming apparatus according to claim 14, further comprising:

an abnormality detecting unit for detecting abnormality in an image formation process, wherein the storage unit stores information regarding the abnormality detected by the abnormality detecting unit in association with the history information.

18. An image forming system comprising:

an image forming apparatus; and a host apparatus connected to the image forming apparatus, the image forming apparatus comprising:

an image forming apparatus main body;

at least one replaceable unit replaceably mounted to the image forming apparatus main body;

an input unit for selecting any one of an operation mode corresponding to the replaceable unit which is a genuine article and operation modes different from the operation mode, a control unit for performing controls according to an operation mode selected by the input unit; and a storage unit for storing history information regarding the operation modes, and the host apparatus comprising:

a display unit for displaying the history information stored in the storage unit.

19. An image forming system comprising:

an image forming apparatus; and a host apparatus connected to the image forming apparatus, the image forming apparatus comprising:

an image forming apparatus main body;

at least one replaceable unit replaceably mounted to the image forming apparatus main body;

an input unit for selecting any one of an operation mode corresponding to the replaceable unit which is a genuine article and operation modes different from the operation mode;

a control unit for performing controls according to an operation mode selected by the input unit;

a storage unit for storing history information regarding the operation modes; and an application quantity determining unit for determining whether or not an application quantity of each of other operation modes exceeds an established reference application quantity, based on the history information stored in the storage unit, and the host apparatus comprising:

a display unit for displaying a purport that an application quantity of each of other operation modes exceeds a reference, when the application quantity determining unit determined that the application quantity exceeds the reference application quantity.

20. A method of controlling an image forming apparatus in which at least one replaceable unit is replaceably mounted to an image forming apparatus main body, the method comprising:

selecting any one of an operation mode corresponding to the replaceable unit which is a genuine article and other operation modes different from the operation mode, according to a request of a user;

performing controls according to the selected operation mode; and storing history information regarding the operation modes.

* * * * *